US005364425A

United States Patent [19]

Simon et al.

[11] Patent Number: 5,364,425

[45] Date of Patent: Nov. 15, 1994

[54] CLEANING DEVICE FOR A CLEAN ROOM

[75] Inventors: Rudolf Simon, Korntal-Münchingen, Germany; John C. Dryden, San Jose, Calif.; Franz Schlitz, Böblingen, Germany

[73] Assignee: Meissner + Wurst GmbH + Co. Lufttechnische Anlagen Gebäude-Und Verfahrenstechnik, Stuttgart, Germany

[21] Appl. No.: 76,021

[22] Filed: Jun. 11, 1993

[30] Foreign Application Priority Data

Jun. 11, 1992 [DE] Germany ..... 4219125
Sep. 18, 1992 [DE] Germany ..... 4231264

[51] Int. Cl.[5] ..... B01D 46/12

[52] U.S. Cl. ..... 55/385.2; 55/471; 55/472; 55/495

[58] Field of Search ..... 55/385.2, 471, 472, 55/473, 484, 493, 494, 495, 497, 499

[56] References Cited

U.S. PATENT DOCUMENTS

| | | | |
|---|---|---|---|
| 4,088,463 | 5/1978 | Smith | 55/385.2 X |
| 4,344,784 | 8/1982 | Deckas et al. | 55/473 |
| 4,427,427 | 1/1984 | DeVecchi | 55/385.2 X |
| 4,518,405 | 5/1985 | Lough et al. | 55/385.2 |
| 4,671,811 | 6/1987 | Cadwell et al. | 55/385.2 X |
| 4,846,859 | 7/1989 | Nobiyaki et al. | 55/473 X |
| 4,883,513 | 11/1989 | Monson et al. | 55/385.2 |
| 5,053,065 | 10/1991 | Garay et al. | 55/385.2 X |
| 5,074,894 | 12/1991 | Nelson | 55/473 X |

FOREIGN PATENT DOCUMENTS

| | | |
|---|---|---|
| 128416 | 11/1977 | German Dem. Rep. . |
| 2104234 | 1/1971 | Germany . |
| 3626321 | 8/1986 | Germany . |

OTHER PUBLICATIONS

Babcock BSH Reinraum-Technik; Reine Arbeitszonene Reinraumgeräte Personal-/Materialschleusen; 27 Jan. 1992.

*Primary Examiner*—Tim Miles
*Attorney, Agent, or Firm*—Robert W. Becker & Associates

[57] ABSTRACT

A cleaning device for a clean room has at least two filter-fan units each comprising a filter and a fan. Connecting elements connect the filter-fan units to one another to form a self-supporting construction unit. Each filter-fan unit comprises a housing having profiled elements for engaging the connecting elements in the form of bars or angled pieces. The connecting elements can be T-shaped or cross-shaped. The construction units can be supported on supports on the floor or suspended from the ceiling.

47 Claims, 18 Drawing Sheets

53
58
14b
14
24
14a
33
32
39
42
73
34
72
35
37
15
34'
41
33'
32'
14a
23
14
14b
55
54
56
38
57
39'
15'
15"
61
62
23
38
54
56
42
24
39
53
54
56

CLEANING DEVICE FOR A CLEAN ROOM

BACKGROUND OF THE INVENTION

The present invention relates to a cleaning device for a clean room having filter-fan units supported by a supporting device.

Clean rooms are equipped with filter-fan units that are, for example, connected to the ceiling. The filter-fan units are supported on a support device or they are screwed to the ceiling. Furthermore, filter-fan units are known which are individually suspended from the clean room ceiling. For arranging the filter-fan units in a certain configuration careful planning is required. Also, the supporting device is of a complicated design, is expensive and difficult to mount. It cannot be installed by the customer, but requires installation by technically trained personnel of the manufacturer.

It is therefore an object of the present invention to improve the aforementioned kind of cleaning devices such that they are simple in their construction and can be mounted by the customer himself.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
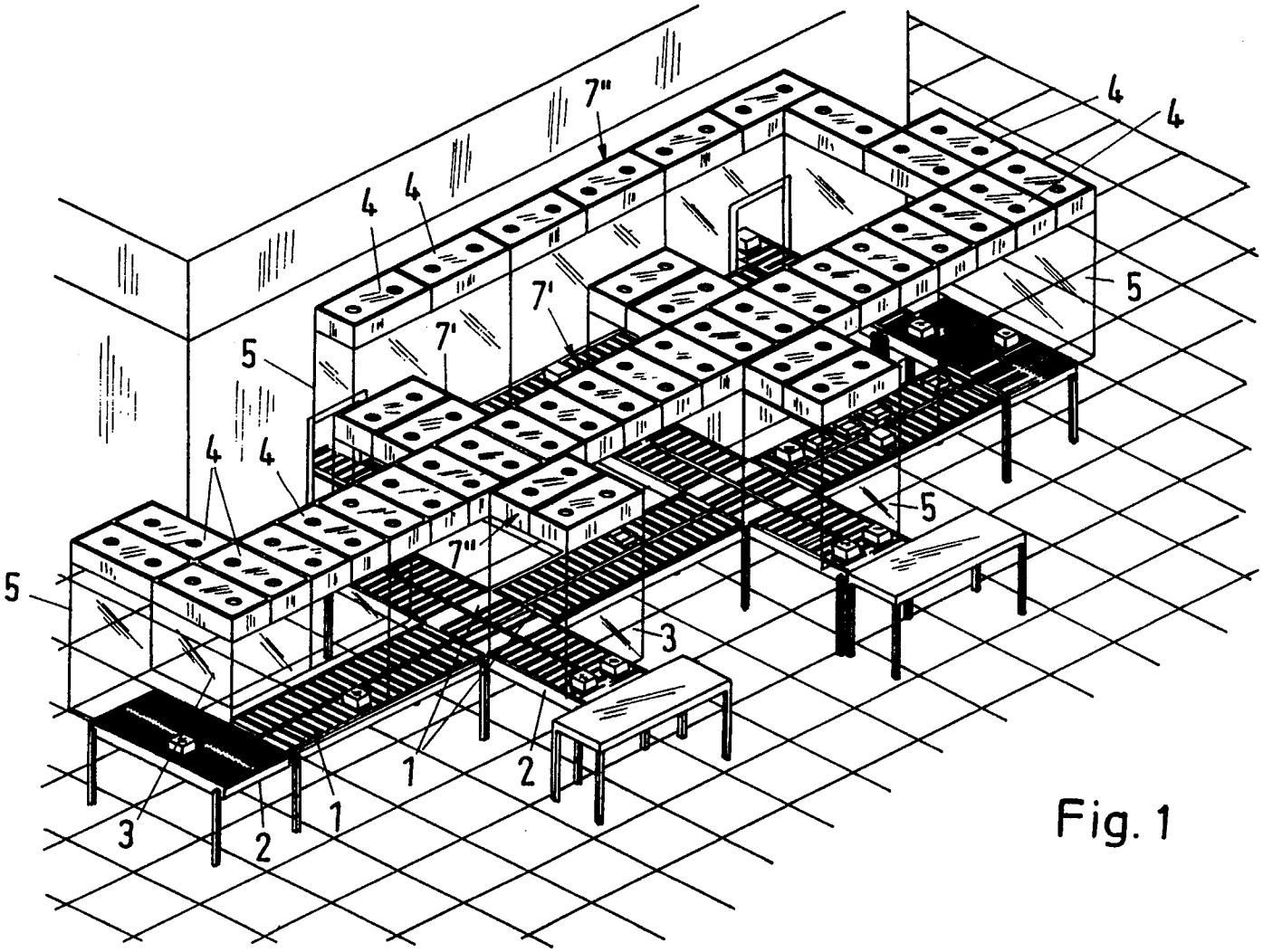
FIG. 1 shows a perspective representation of self-supporting construction units comprised of filter-fan units arranged above transporting devices.

The cleaning device for a clean room according to the present invention is primarily characterized by at least two filter-fan units, each comprising a filter and a fan, and connecting elements for connecting the filter-fan units to one another to form a self-supporting construction unit.

Due to the inventive embodiment a plurality of filter-fan units can be connected to form a self-supporting modular construction unit. Accordingly, such construction unit can be assembled in a simple manner by the customer, especially because the construction units can be connected to simple supports. A complicated and thus expensive support construction for the filter-fan units is no longer needed. The construction units can be assembled from the filter-fan units at the site. Since an expensive and complicated support construction is no longer required, it is no longer necessary to devise a special plan for mounting the inventive cleaning devices so that with the construction units an inexpensive, variable, and simple mounting and thus a quick installation of the cleaning device is possible. Especially for larger facilities this advantage is especially noticeable. With the modular construction it is also possible to provide smaller clean room facilities with the inventive cleaning device. Larger clean rooms can also be equipped in the inventive manner in an inexpensive and simple fashion.

In a preferred embodiment of the present invention, each filter fan unit comprises a housing having profiled elements, wherein the connecting elements are selected from the group consisting of bars and angle pieces. Preferably, the connecting elements are T-shaped or cross-shaped.

The cleaning device preferably further comprises clamping pieces selected from the group consisting of keys and hammer bolts, the clamping pieces connected to the profiled elements and interposed between the connecting elements and the profiled elements. Preferably, the profiled elements have substantially C-shaped receiving means for receiving therein the clamping pieces.

Advantageously, each housing comprises a wall with an upper and a lower longitudinal edge, with the profiled elements provided at the wall. Preferably, the wall is a sidewall of the housing and is in the form of a hollow profiled member. In a preferred embodiment of the invention, the profiled elements are located at the upper longitudinal edge of the wall and/or at the lower longitudinal edge of the wall. The profiled elements are located at an outwardly facing side of the wall. Preferably, the profiled elements extend substantially over an entire longitudinal length of the wall. In a preferred embodiment, at least one of the upper and the lower longitudinal edges, preferably both longitudinal edges have at least two of the profiled elements that are located directly adjacent to one another. Preferably, the at least two profiled elements are oriented perpendicularly to one another.

Expediently, the cleaning device further comprises at least one sealing element located between two neighboring ones of the filter fan units. Preferably, the sealing element is located within one of the profiled elements. In a preferred embodiment of the present invention, the housing further comprises a bottom wall in the form of a grate. Advantageously, the housing further comprises a longitudinal channel located above a lowermost one of the profiled elements forming the lower longitudinal edge of the sidewall, the bottom wall extending into the longitudinal channel. The bottom wall is preferably made of mesh metal or expanded metal.

In a preferred embodiment of the present invention, the cleaning device further comprises supports for supporting the construction unit, the supports connected with connectors to the profiled elements. The connectors are preferably screws. In a further embodiment of the present invention, the cleaning device further comprises clamping pieces connected to the profiled elements and interposed between the supports and the profiled elements for detachably connecting the supports to the profiled elements, the connectors extending through the supports and engaging the clamping pieces.

Expediently, the cleaning device further comprises supporting members selected from the group consisting of longitudinal supporting members and transverse supporting members, with at least the longitudinal supporting members connecting the supports to one another. The transverse supporting members are preferably connected on top of the longitudinal supporting members, preferably by screws. Expediently, the supports and the longitudinal supporting members are detachably connected.

Advantageously, the cleaning device further comprises suspending members for suspending the construction unit, the suspending members comprising couplings for connecting the suspending members to the wall of the housing. The couplings are preferably connected to the profiled elements of the wall. Preferably, the suspending members are cables.

In a preferred embodiment of the present invention, the cleaning device further comprises electrical connecting elements for electrically connecting at least some of the filter-fan units of the construction unit with one another. Preferably, the filter-fan unit has an electric plug for receiving one of the electrical connecting elements. The electrical connecting elements are preferably electrical cables.

Preferably, the cleaning device of the present invention further comprises holders for supporting the construction units. The holders are preferably angle supports.

Expediently, the cleaning device further comprises a separating device connected to the periphery of the construction unit for separating the construction unit from the surroundings. In another embodiment of the present invention, the filter fan unit of the cleaning device further comprises a frame for connecting the filter to the housing. The frame extends over the entire height of the filter and is supported at the housing.

Preferably, each housing has sidewalls and abutting ones of the sidewalls of neighboring filter-fan units are detachably connected to one another. The abutting sidewalls are preferably screwed together. In another embodiment, the cleaning device comprises bolts for detachably connecting the abutting sidewalls, whereby the bolts penetrate the abutting sidewalls below the filters. In another embodiment of the present invention, each abutting sidewall has an upper and a lower edge with an L-shaped outwardly extending projection, the L-shaped projections having a free leg extending parallel to the abutting sidewall toward one another, with the free legs of the abutting sidewalls abutting one another. Preferably, the free legs of the projections at the lower edges are screwed together.

Expediently, each housing has a top plate with a substantially L-shaped projection extending upwardly from the housing. The L-shaped projection has a free leg extending parallel to the top plate toward a center of the housing. Neighboring filter-fan units are connected to one another with the L-shaped projections. Preferably, the L-shaped projections are screwed together. In another embodiment of the present invention, the housing has planar sidewalls, wherein neighboring ones of the filter-fan units abut one another with the planar sidewalls. Each planar sidewall has a lower edge with a profiled end section and a profiled member inserted into the profiled end section.

In another embodiment of the present invention, each planar sidewall has a lower edge with a profiled end section filled with a permanent-elastic sealing material.

Description of Preferred Embodiments

Figure 2:
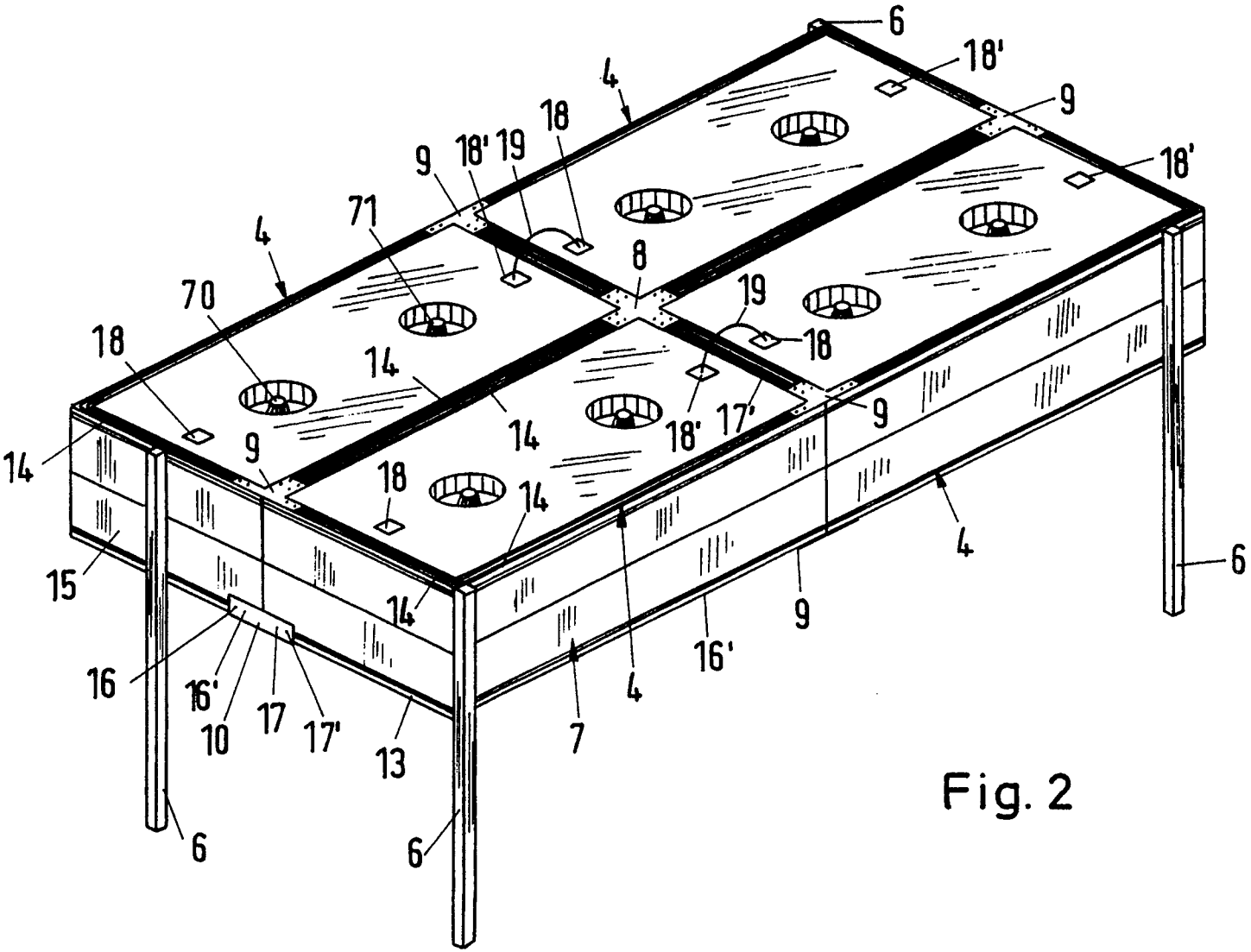
FIG. 2 is an enlarged, perspective representation of a construction unit comprised of four filter-fan units carried by supports.

In a clean room 3 according to FIG. 1, products sensitive to soiling and dust, for example, wafers, are transported in a known manner in containers with transporting devices 1 which are arranged on tables 2 etc. The clean room area 3 is upwardly delimited by filter-fan units 4 and laterally delimited by separating devices or wall pieces 5 which are connected to the filter-fan units. The filter-fan units 4 are supported on the floor by supports 6 (FIG. 2). The support 6 are not represented in FIG. 1 in order to simplify the drawing.

The clean room area 3 can have any desired shape. In the embodiment represented the clean room is comprised of sections that are arranged perpendicular to one another.

The filter-fan units 4 are modules and are assembled to form self-supporting modular construction units 7 (FIG. 2). According to FIG. 2, four identically constructed filter-fan units 4 are assembled to a modular construction unit. As is shown in FIG. 1, it is also possible to combine a plurality of filter-fan units 4 to a construction unit 7' when arranging them one after another in series or, for example, to combine two adjacently arranged filter-fan units to a construction unit 7''. The filter-fan units 4 can be assembled in any desired arrangement and number to different modular construction units. In the construction unit 7 according to FIG. 2, two filter-fan units 4 which have a rectangular contour abut one another with their longitudinal sides, while the two resulting pairs of filter-fan units furthermore abut with their narrow sides. The construction unit 7' (FIG. 1) is comprised of a number of filter-fan units 4 which abut one another with their longitudinal sides. The filter-fan units 4 of the construction unit 7" are connected to one another with their narrow sides.

Figure 4:
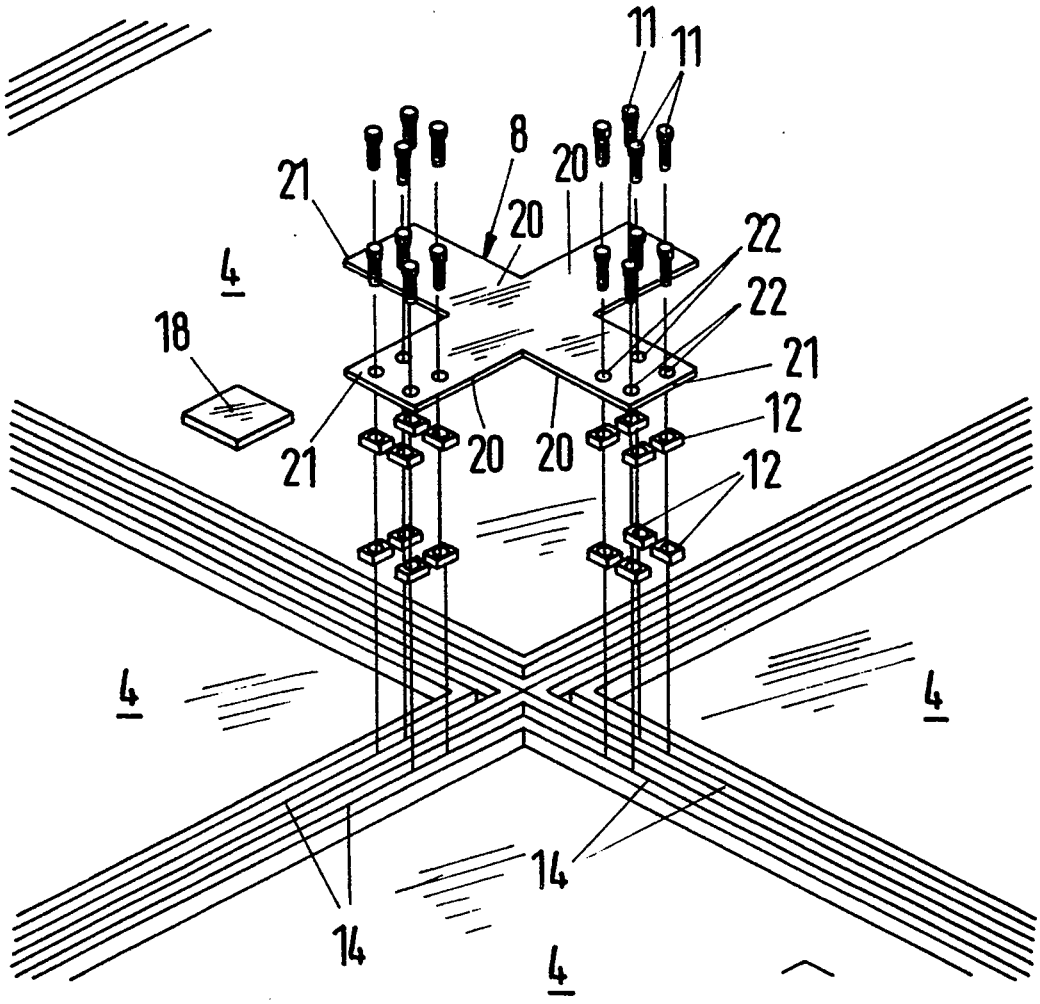
FIG. 4 is an exploded view of connecting elements with which four filter-fan units are combined to a self-supported construction unit.

The filter-fan units 4 of the respective construction unit are connected to one another by connecting elements 8 to 10 (FIG. 2). The connecting elements 8 to 10 are comprised of sheet metal material and are attached to the housing 13 of the corresponding filter-fan unit 4 with screws 11 and keys 12 (FIG. 4). For connecting four filter-fan units 4 that are arranged in pairs cross-shaped connecting elements 8 are used and for connecting two adjacent filter-fan units T-shaped and strap-shaped connecting elements 9 and 10 are used. Instead of these connecting elements 8 to 10, or additionally, it is possible to use longitudinal supporting members (FIG. 14) that extend over the entire length of the construction unit.

The cross-shaped connecting elements 8 are provided at the upper and underside at the junction where the four filter-fan units abut. The T-shaped connecting elements 9 are provided at the edges of the filter-fan units 4 at their upper and underside while the strap-shaped connecting elements 10 are provided at the sidewalls of the construction unit (FIG. 2). Each filter-fan unit 4 has two fans 70, 71 (FIG. 2) which are spaced apart from another. At the upper side of each filter-fan unit 4 connecting plugs 18, 18' for supplying the fans 70, 71 with electricity is provided. Via the connecting plugs 18, 18' it is possible in a simple manner to connect electrically neighboring filter-fan units 4 by cable 19. The filter-fan unit, in a deviation from the represented embodiment, may be provided with only one fan or may have more than two fans.

The connecting element 8 has four arms 20 of identical length (FIG. 4), each having at their free ends 21 four openings 22 for the screws 11. Each screw 11 has coordinated therewith a key 12. The keys 12 are inserted into slots 14 which are provided at the housing 13 of the filter-fan unit and into which the screws 11 are threaded. As shown in FIG. 4, each arm 20 is connected to two adjacently positioned filter-fan units 4 with the keys 12 and the screws 11. Since each arm 20 has coordinated therewith four screws 11, a secure fastening of the connecting element 8 at the junction of the four filter-fan units 4 is ensured. The cross-shaped connecting element 8 provides high stability at the junction of the construction unit 7 comprised of the four filter-fan units due to the aforedescribed embodiment and fastening.

In the T-shaped connecting elements 9 (FIG. 5), the crossbar 25 is narrower than the stem 26 which has approximately the same width as the arms 20 of the connecting element 8. The stem 26 is connected to two adjacently arranged slots 14 of neighboring filter-fan units 4 (FIG. 2) in the same manner as the arm 20 of the cross-shaped connecting element 8. The crossbar 25 is connected to the aligned slots 14 of these filter-fan units 4. The stem 26 is provided at its free end with openings 27 for receiving the screws 11, while the two ends 28, 29 of the crossbar 25 each are provided with two openings 30, 31 which in the longitudinal direction of the crossbar 25 are spaced from one another. Due to the T-shaped embodiment neighboring filter-fan units 4 of one construction unit are especially securely fastened to one another.

Instead of a T-shaped connecting element 9, or additionally, the neighboring filter-fan units 4 of a construction unit may also be connected to one another by the strap-shaped connecting elements 10 which are attached to the end faces of the filter-fan units 4 (FIG. 2) or to the upper and undersides with keys 12 and screws 11. The connecting elements 10 are provided at their ends with openings 16, 16' and 17, 17' which are spaced from one another in the longitudinal direction of the element 10.

Figure 5:
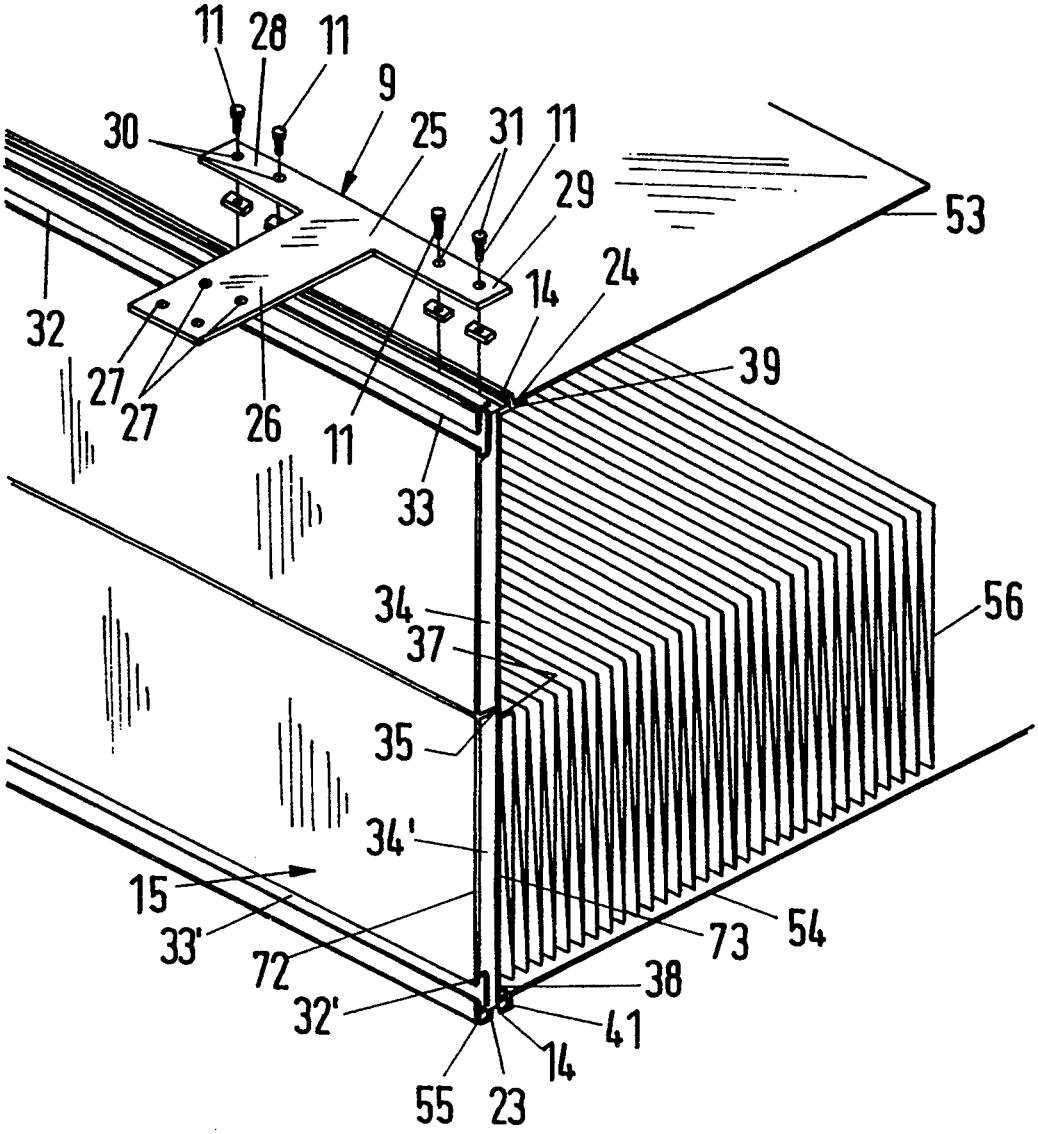
FIG. 5 is a perspective and partially exploded view of a filter-fan unit of an inventive cleaning device.
Figures 6, 7, 8, 9:
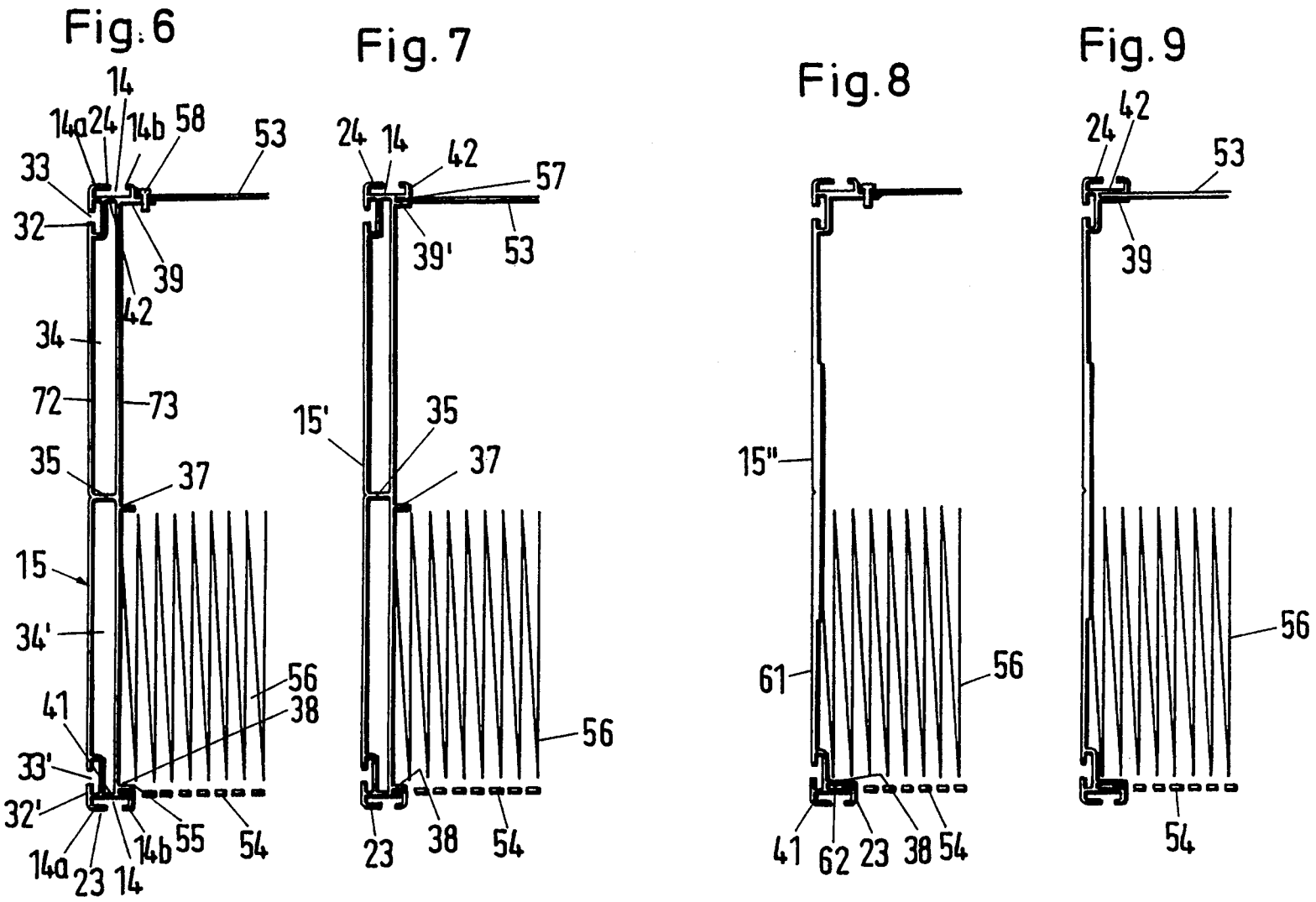
FIGS. 6–9 show different embodiments of filter-fan units.

The housing of the filter-fan unit 4 is comprised of walls 15 which preferably are identical on all housing sides. As is shown in FIG. 5, the wall 15 is in the form of a hollow profiled member which has two hollow interiors 34, 34' separated by an intermediate wall 35. The hollow interiors 34, 34' are essentially mirror-symmetrical relative to the intermediate wall 35. The wall 15 may, of course, also be embodied in an asymmetrical fashion. The intermediate wall 35 may also be omitted. However, it is also possible to provide the wall 15 with further intermediate walls. The hollow interiors 34, 34' are substantially rectangular and are delimited by two parallel side walls 72, 73 which are connected to one another by the intermediate wall 35 at half their height. At both ends the two sidewalls 72, 73 are connected to one another by profiled elements 23, 24 which are provided with the slots 14 (FIGS. 5 and 6). The sidewall 72 has two further profiled elements 32, 32' arranged adjacent to the profile elements 23, 24 which have a C-shaped cross-section as do the profiled elements 23, 24. The profiled elements 32, 32' are oriented perpendicular to the profiled elements 23, 24 so that the slots 33, 33' of the profiled elements 32, 32' lie in the plane of the sidewall 72. The profiled elements 32, 32' extend into the respective hollow interior 34, 34'. Due to the embodiment of the hollow profiled member of the wall 15, the wall 15 has a minimum weight with a high stability.

The profiled elements 23, 24 and 32, 32' are preferably identical to one another. As shown in FIG. 6, the profiled elements 23, 24 extend inwardly past the inner side of the wall 15 formed by the inner sidewall 73.

The two legs 14*a*, 14*b*, 14*a*', 14*b*' of the profiled elements 23, 24 have different widths. The legs 14*a*, 14*a*' which extend from the outer sidewall 72 have twice the width of the legs 14*b*, 14*b*'.

From the inner sidewall 73 longitudinal stays 37 to 39 project at a right angle. The stay 37 is positioned slightly below the intermediate wall 35, and the stay 38 is positioned at a short distance above the bottom 41 of the profiled element 23 which extends inwardly past the sidewall 73. The longitudinal stay 39 forms an extension of the bottom 42 of the profiled element 24 and extends past the sidewall 73. Only with regard to the embodiment of these longitudinal stays 37 to 39, the wall 15 is not mirror-symmetrical to the intermediate wall 35.

Figure 10:
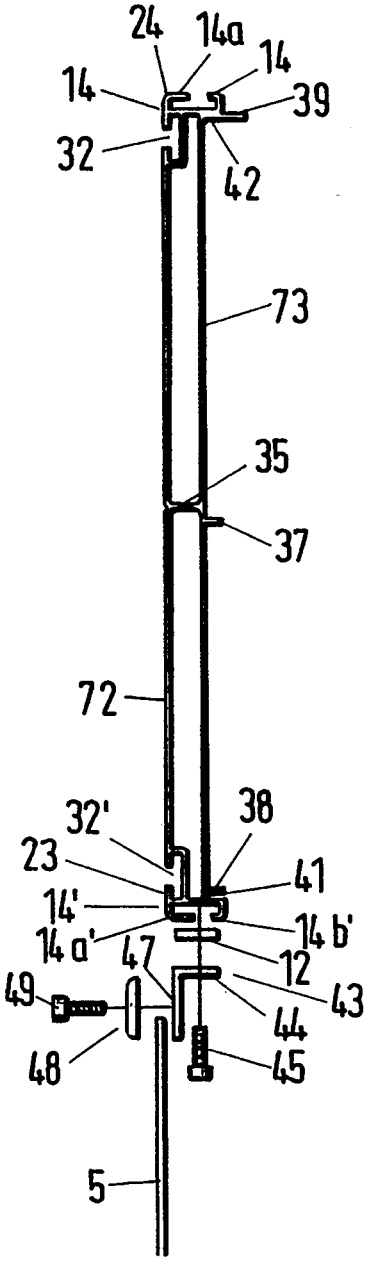
FIG.10, 11 shows one embodiment for fastening a separating device at the housing according to FIG. 6 of a filter-fan unit.

The lower profiled element 23 serves to fasten the separating device or wall section 5 of the clean room 3 which is preferably a curtain made of polyvinyl chloride (FIG. 10). However, it may also be made of any other suitable material. The wall section is connected with screws to a holding device 43 which is attached to the profiled element 23. The holding device 43 in the shown embodiment is an angle rail with L-shaped cross-section having a shorter leg 44 that is fastened with at least one key 12 inserted into the slot 14 and with screws 45 at the profiled element 23. The leg 44 rests on the legs 14*a*', 14*b*' of the profiled element 23. The longer leg 47 of the holding device 43 has fastened thereto the wall section 5 which is clamped with screws 49 between the leg and a clamping rail 48. The screws 48 penetrate the upper edge of the wall section 5 and the clamping rail 48 and are threaded into threaded bores of the legs 47 of the holding device 43.

Figure 11:
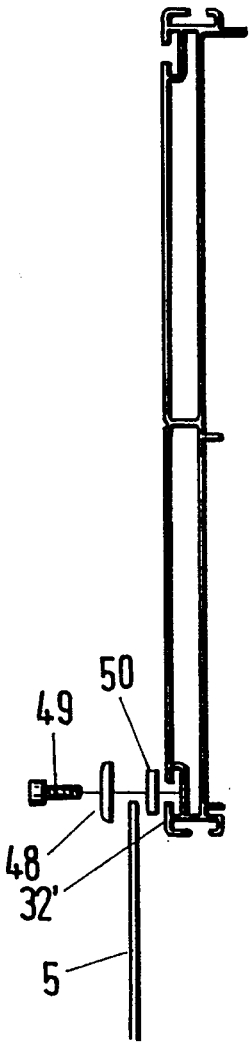
Figure 12:
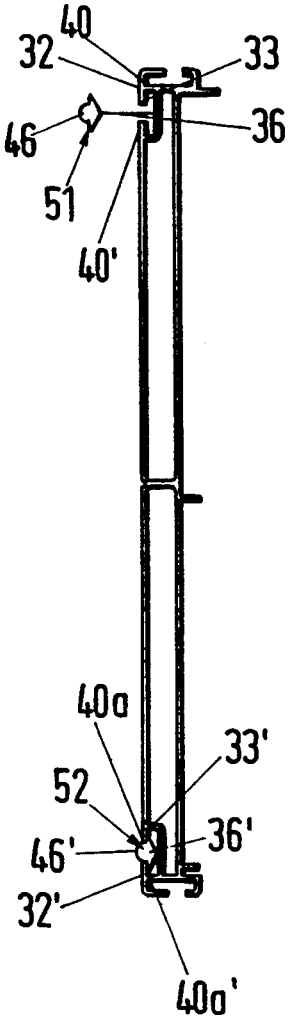
FIG. 12 shows the housing wall according to FIG. 10 with a sealing element within the profiled elements.

The wall section 5 may also be a glass or plastic pane. The wall section 5 may also be connected within the lateral profiled element 32', as shown in FIG. 11. In this case, keys 50 are inserted into the slot of the profiled element 32'. The wall section rests at the legs of the profiled element 32' and is clamped between the legs and the clamping part 48 with screws 49. Sealing elements 51, 52 can be inserted into the profiled elements 32 and 32' (FIG. 12) for sealing the adjacently positioned filter-fan units 4 of a construction unit relative to one another at their contact surfaces. The sealing elements 51 and 52 can be easily pressed through the openings 33, 33' into the slots of the profiled elements 32, 32'. The holding portion 36, 36' of the sealing elements 51, 52 engage the legs 40, 40' and **40*a*, 40*a'* of the profiled elements 32, 32'** so that the sealing elements are securely fastened.

As shown in FIGS. 5 and 6, the edge of a top plate 53 of the housing 13 rests on the longitudinal stay 39 of the wall 15. The edge 55 of the bottom wall 54 extends into the slot formed between the bottom 41 of the lower profiled element 23 and the longitudinal stay 38. Above the bottom 54 a filter pack 56 is arranged which is secured in the upward direction by the longitudinal stay 37 engaging the edges of the filter pack. The bottom 54 is provided with air openings in a known manner and is preferably formed by mesh metal or expended metal.

According to FIG. 6, the top plate 53 of the housing 13 is connected to the longitudinal stay 39 with screws 58.

As shown in FIG. 7, instead of the longitudinal stay 39 a stay 39' which extends perpendicularly from the inner sidewall 73 into the interior can be provided below the bottom 42 of the upper profiled element 24 which extends past the inner sidewall 73 to the same extent as the profiled element 24. Into the gap 57 between the longitudinal stay 39' and the bottom 42 of the profiled element 24 the edge of the top plate 53 can be inserted. A securing with screws is not required. Also, the wall 15' is identical to the embodiment according to FIG. 6.

The embodiment according to FIG. 8 differs from the embodiment according to FIG. 6 only in that the wall 15'' is not in the form of a hollow profiled member, but is a single wall 61. The slot 62 between the bottom 41 of the lower profiled element 23 and the longitudinal stay 38 is wider than in the aforedescribed embodiments. In all other respects the present embodiment corresponds to the embodiment according to FIG. 6.

The embodiment according to FIG. 9 differs from the embodiment according to FIG. 8 only in that the top plate 53 with its edge is held between the bottom 42 of the profiled element 24 in the longitudinal stay 39 as has been described for the embodiment according to FIG. 7. Accordingly, this embodiment, with the exception of the single wall design, corresponds to the embodiment according to FIG. 7.

Figure 3:
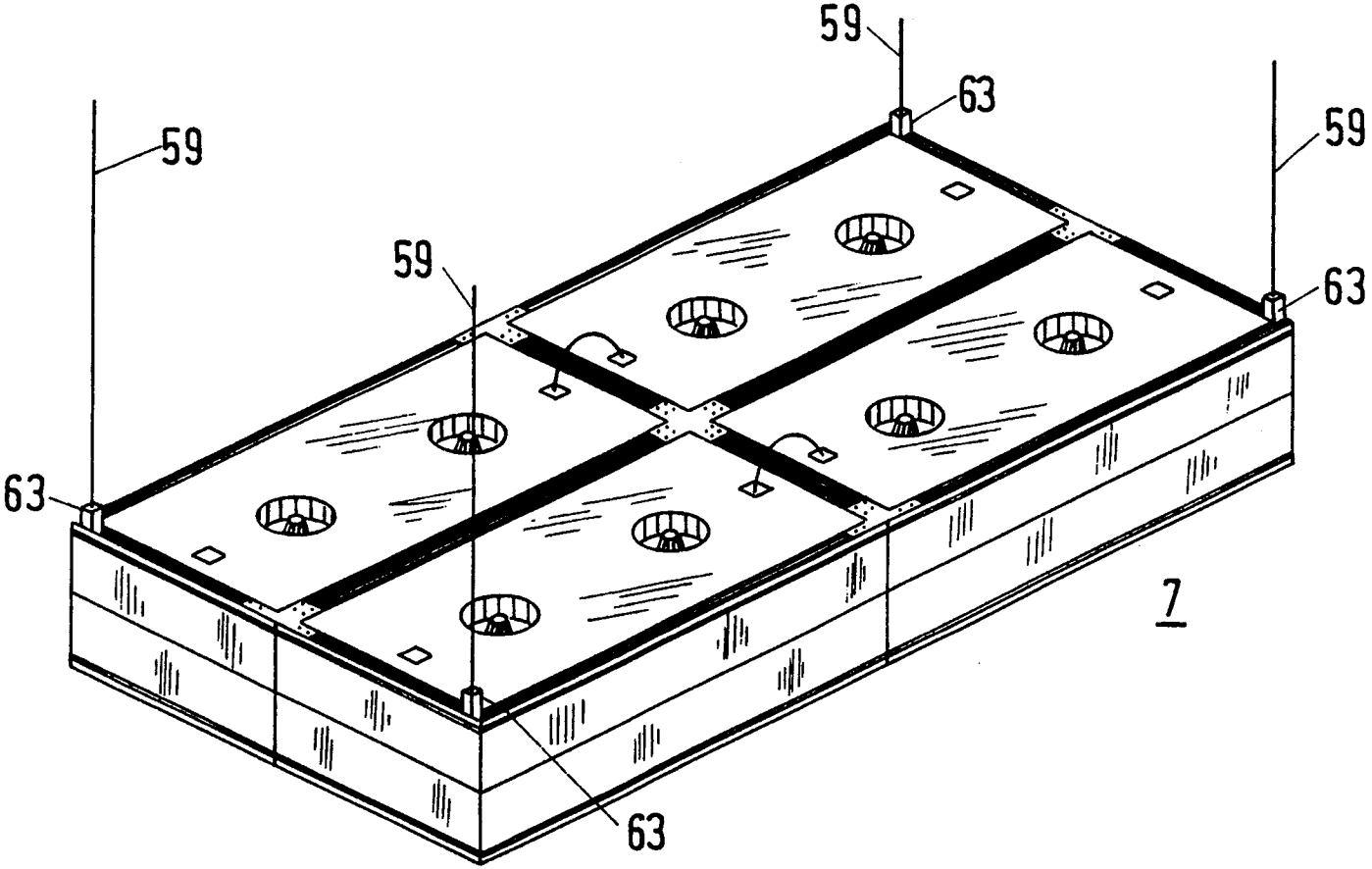
FIG. 3 is an enlarged, perspective representation of a constructive unit comprised of four filter-fan units which are suspended.

Instead of the support 6 according to FIG. 2 the construction units 7 may also be suspended from the ceiling or under construction of a room etc. (FIG. 3). For this purpose, wire cables 59 are provided which are connected via couplings 63, such as blocks etc., at the upper profiled elements 24. The coupling 63 can be screwed with keys into the profiled elements in the same manner as the supports 6. Instead of the wire cables it is also possible to use profiled stays made of steel, aluminum, etc.

Figure 14:
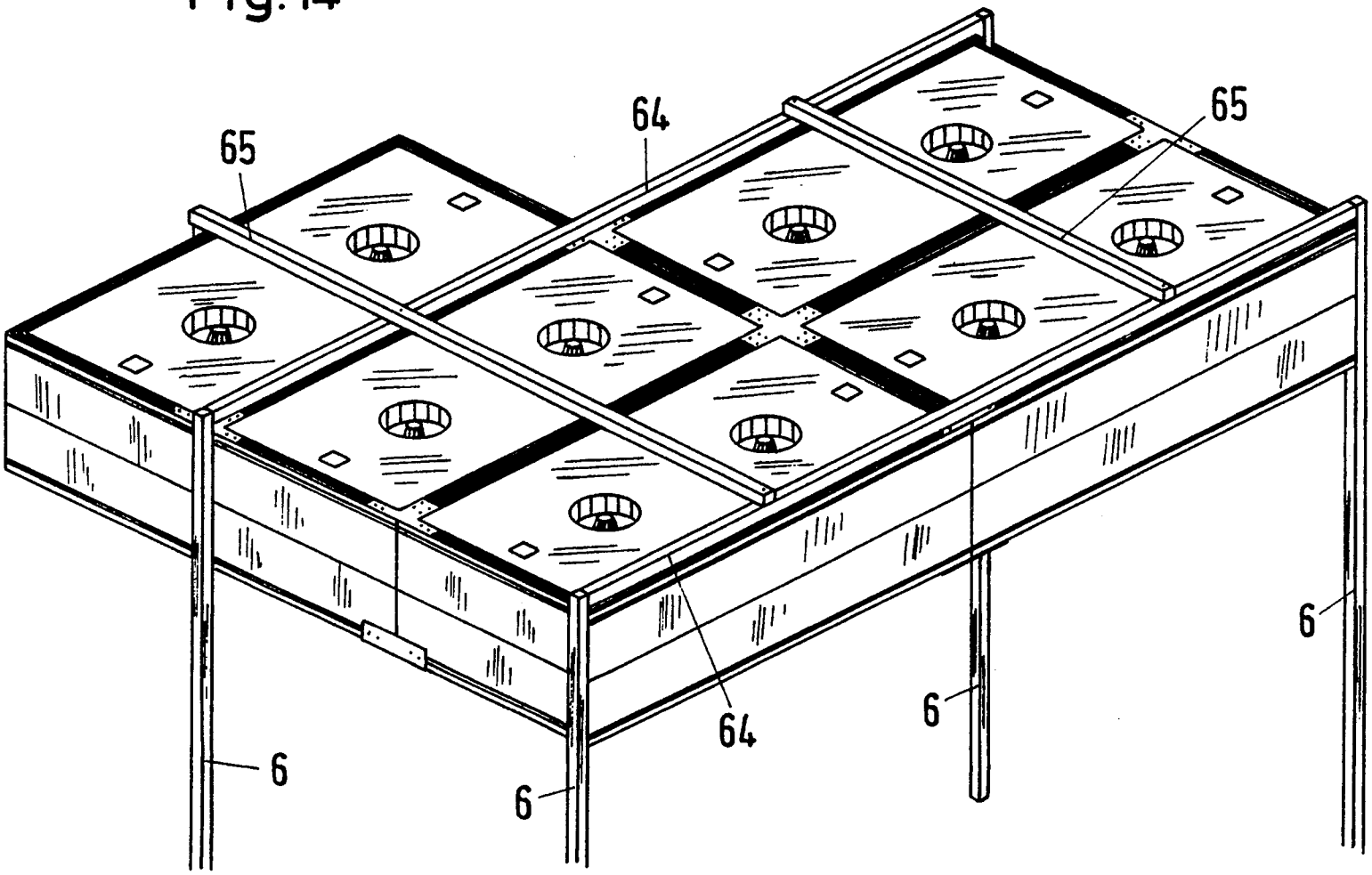
FIG. 14 is a further embodiment of a construction unit of the inventive cleaning device.

In the embodiment according to FIG. 14 the support 6 may be connected to one another by longitudinal supporting members 64 which are fastened to the profiled elements 24 and/or to the supports 6. Transverse supporting members 65 may be attached to the top of the longitudinal supporting members 64 so that the construction unit in the transverse direction are connected to the longitudinal supporting members 64. The longitudinal supporting members 64 and/or the transverse supporting members 65 impart a great stability to the construction unit.

Figure 13:
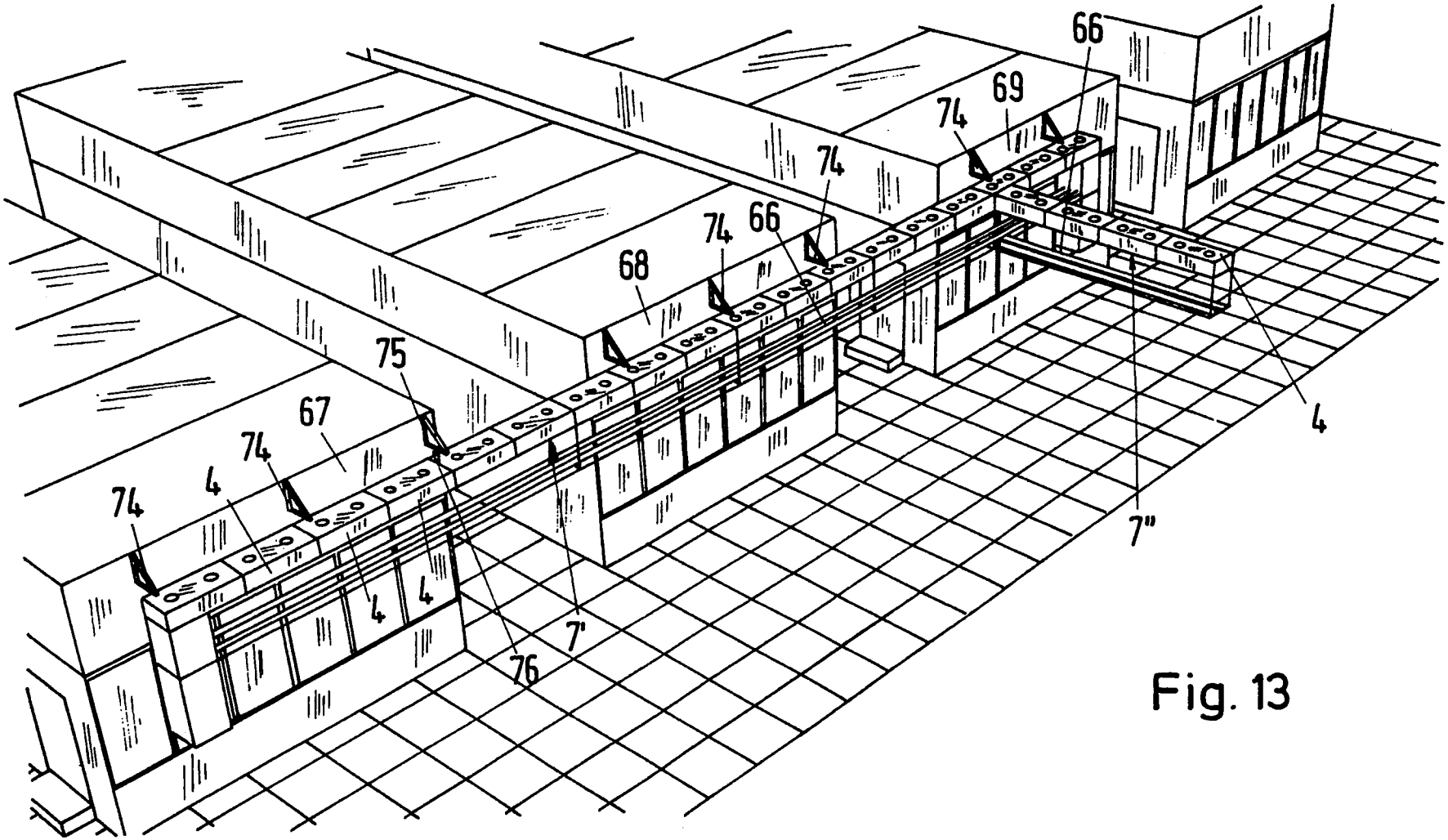
FIG. 13 is a perspective representation of a further embodiment of the arrangement of self-supporting construction units which are comprised of filter-fan units.

It is also possible that the filter-fan units 4 are connected in series one after another, as shown in FIG. 13, whereby the filter-fan units are connected with their narrow sides. In the represented embodiment a second construction unit 7'' is connected to the first construction unit 7; the second unit 7'' also comprised of filter-fan units 4 arranged in series one after another and positioned at a right angle to the second construction unit 7''. This constructively very simple arrangement serves, for example, for sealing off a transport system 66 for wafers which is positioned below the construction units 7', 7''. The construction units 7', 7'' have connected thereto separating members or wall sections 67 to 69 which are suspended via holders 74. These holders 74 are preferably triangular angle supports which are connected with one leg 75 to the walls 67 to 69. The other leg 76 is connected to the profiled elements of the filter-fan-unit 4 in the aforedescribed manner, preferably with keys and screws.

Figure 15:
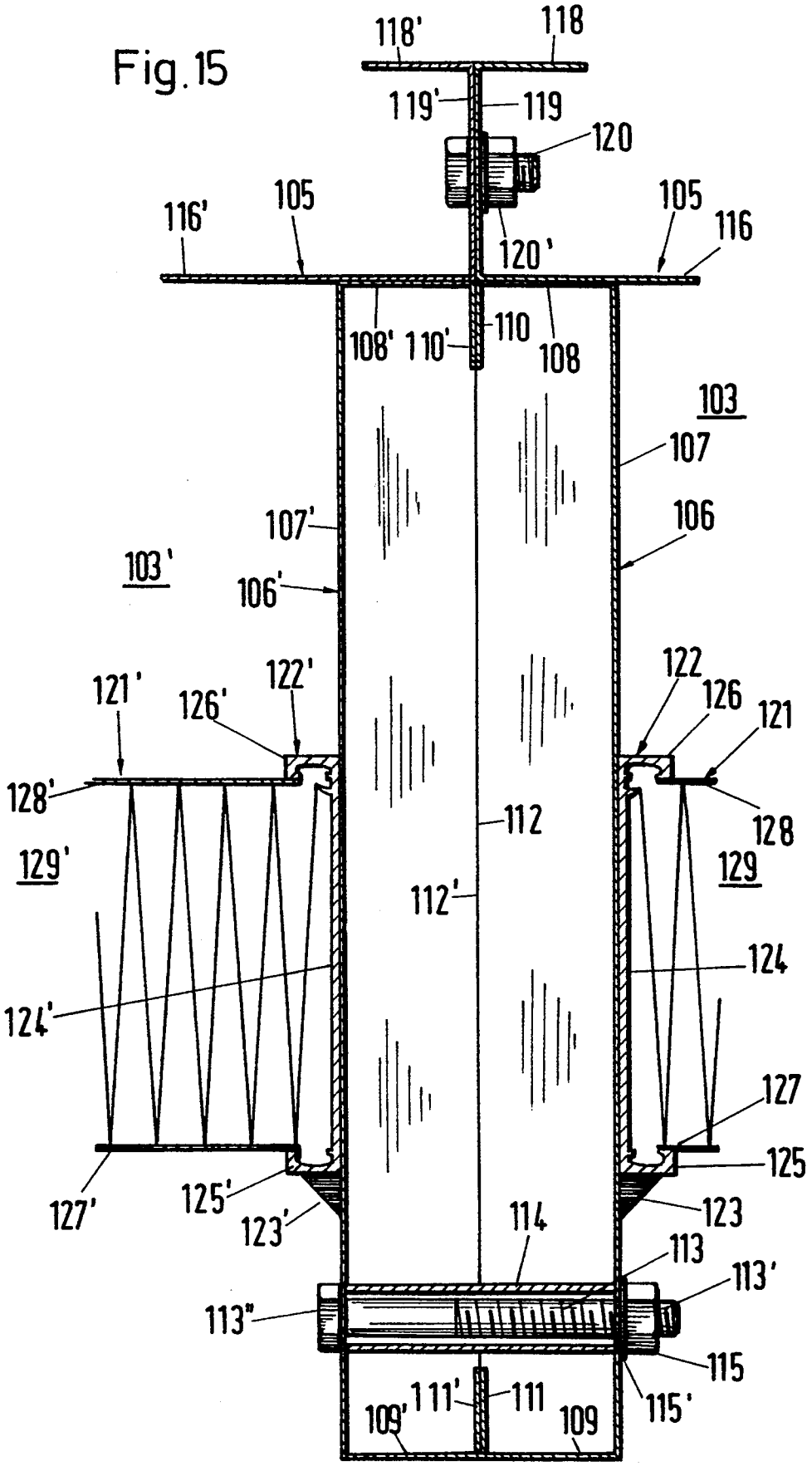
FIG. 15 shows an enlarged representation and in section a portion of two filter-fan units connected to one another in a further embodiment of the inventive cleaning device.
Figure 18:
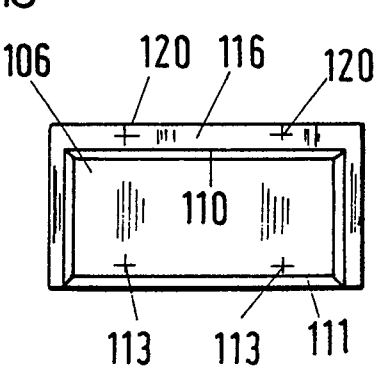
FIG. 18 is a view in direction of arrow XVIII in FIG. 16.

In the embodiment according to FIGS. 15 to 21 the housing 105 which is preferably rectangular is formed by sidewalls 106, 106' which are preferably identical for all four housing sides. The filters 129, 129' are connected to the walls with frames 122, 122'. As shown in FIG. 15, the wall 106 is embodied, when viewed in a longitudinal cross-section, as a C-shaped hollow profile. The wall portion 107, 107' of the hollow profiled member is positioned facing the interior of the housing and has L-shaped projections 108, 109, 108', 109' with free ends that extend parallel to the sidewalls and are aligned with one another. They are provided at the outwardly facing side of the housing sidewall 106, 106', which is open between the free ends 110, 111, 110', 111', and extend toward one another thereby delimiting a wall opening 112, 112' in the outward direction. The free ends 110, 111, 110', 111' in the embodiment are shorter than the legs 108, 109, 108', 109' and are substantially shorter than the wall portion 107, 107' so that the outwardly facing side of the housing wall is open over more than three quarters of its height.

Two filter-fan units 103, 103' that are neighboring one another are connected via their walls (sidewalls) 106, 106' (FIG. 15). The walls 106, 106' rest at one another with their free ends 110, 111 and 110', 111' and are connected to one another with threaded bolts 113 penetrating the wall openings 112, 112'. The threaded bolts 113 are preferably positioned at a short distance above the lower free ends 111, 111' and extend through aligned, non-represented openings of the wall portions 107, 107' of the walls 106, 106'. Between the wall portions 107, 107' spacer sleeves 114 are provided for spacing the wall portions. The threaded bolts 113 extend through the spacer sleeves 114. A nut 115 is threaded onto the end of the bolts 113' which penetrate through the wall portion 107 and are supported with an intermediate washer 115' at the wall portion 107. The head 113'' of the threaded bolt 113 rests at the inwardly facing side of the housing wall 106' of the filter-fan unit 103'. The walls 106, 106' of neighboring filter-fan units 103 and 103' are fixedly attached to one another by the threaded bolt 113 with the nut 115. The free ends 111, 111' therefore also contact one another at a respectively high pressure. Between the free ends 111, 111' sealing elements, not represented, are inserted which seal the slot between neighboring filter-fan units 103, 103' in a reliable manner. These sealing elements are elastically deformed between the free ends 111, 111' when the threaded bolt 113 are tightened. In this manner, a secure sealing action is ensured. The sealing action within the area of the free ends 111, 111' may, of course, be achieved in any other suitable manner.

The filter-fan units 103, 103' are closed off in the upward direction by top plates 116, 116' which are connected, preferably screwed, onto the legs 108, 108' of the L-shaped projection.

In order to connect the walls 106, 106' also at their upper end faces, respectively, at their legs 108, 108', the top plates 116, 116' have edges that are provided with an L-shaped projection. The top plates 116, 116' have an upwardly extending portion 119, 119' which is essentially an extension of the projections 110, 110'. While the legs 110, 110' extend in the direction toward the mirror-symmetrically arranged legs 111, 111', the legs 119, 119' extend in the opposite direction upwardly relative to the legs 110, 110'. The neighboring filter-fan units 103, 103' have areal contact in the upper area at the free ends 111, 111' and the legs 119, 119'. The free ends 118, 118' of the L-shaped projections 119, 119' extend at a right angle inwardly to the center of the housing so that the free ends 118 and 118' of neighboring filter-fan units 103, 103' are oppositely oriented relative to one another. The abutting L-shape projections 119, 119' are connected to one another by threaded bolts 120, with nuts 120'. Between the legs 119, 119' a seal is preferably inserted, not represented in the drawings, which is elastically clamped by the clamping bolt 120. The sealing in this area may also be achieved in any other suitable manner.

The filter elements 121, 121' of the filters 129, 129' are, as can be seen in FIG. 15, arranged within the frames 122, 122' which are supported at the walls 106, 106', respectively their wall portions 107, 107'. The filters 129, 129' are detachably connected to the housing 105 which will be explained in detail infra. This has the advantage that the filter 129, 129' can be exchanged as needed any time. It is also possible to use conventional filters. Below the frame 122, 122' of the filter 129, 129' a sealing bead 123, 123' is provided at the wall 106, 106'. This sealing bead 123, 123' seals the frame 122, 122' with respect to the housing wall 106, 106'. Furthermore, the sealing bead 123, 123' secures the frame 122, 122' at the housing 105 against sliding. As a means against displacement for the frame 122, 122' it is also possible to use abutments, for example, screws which are threaded into the housing walls 106, 106' and on which the frames are supported.

The filter frames 122, 122' have a vertical wall 124, 124' with which the frame rests areally at the wall portions 107, 107' of the wall 106, 106'. Furthermore, the frame 122, 122' has legs 125, 125' and 126, 126' which extend perpendicular from the wall 106, 106'. Between the oppositely arranged legs 125 and 126, respectively, 125' and 126' the filter element 121, respectively, 121' is secured. The inner side of the legs 125, 126, 125', 126' is advantageously concavely curved so that the legs 125, 126, 125', 126' have a certain elasticity since they have only a reduced thickness at half their length. Therefore, they can rest under prestress on covers 127, 128, 127', 128' which cover the filter elements 121, 121' at the upper and underside. The covers 127, 128, 127', 128' are preferably grates made of mesh metal or expanded metal which are securely held by the legs 125, 126, 125', 126'. The legs 125, 126, 125', 126' have at their free ends planar support surfaces for the covers 127, 128, 127', 128' which thus can be reliably secured in their position.

Figure 16:
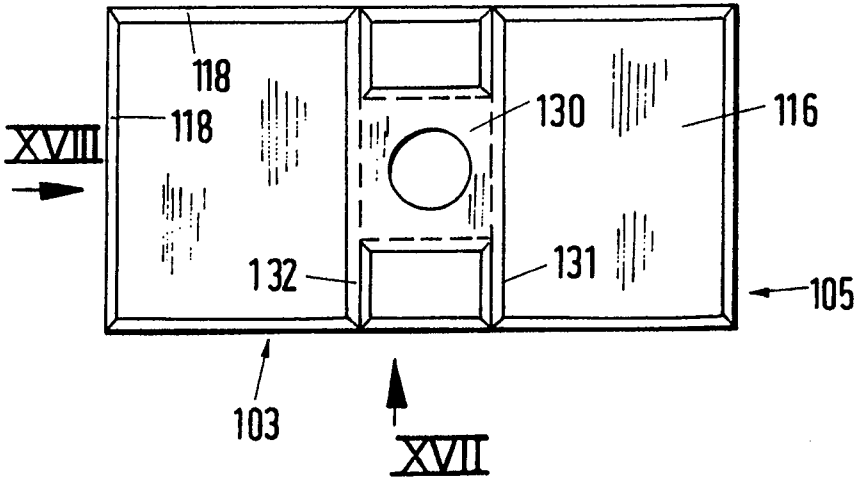
FIG. 16 is a plan view of a filter-fan unit according to FIG. 15.
Figure 19:
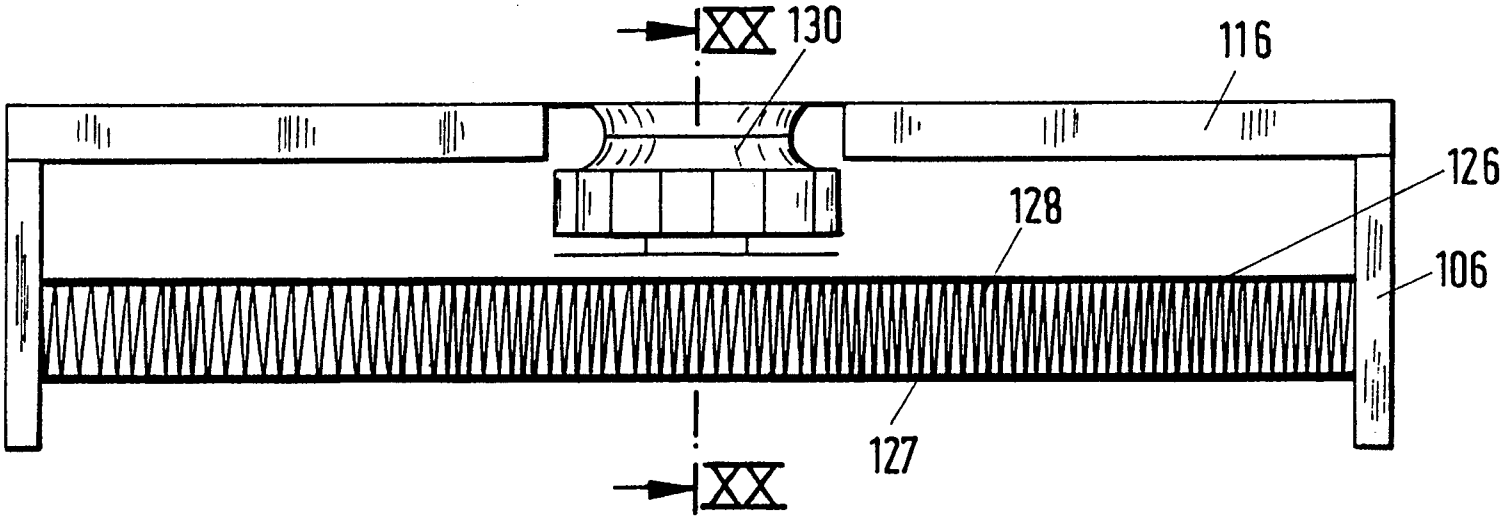
FIG. 19 shows the filter-fan unit according to FIG. 15 in a longitudinal section along the line XIX—XIX in FIG. 20.
Figure 20:
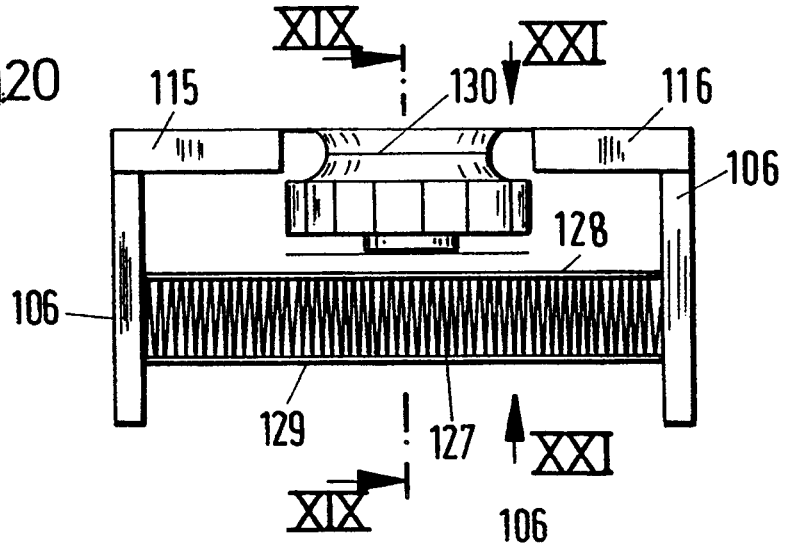
FIG. 20 shows a section along the line XX—XX in FIG. 19.
Figure 21:
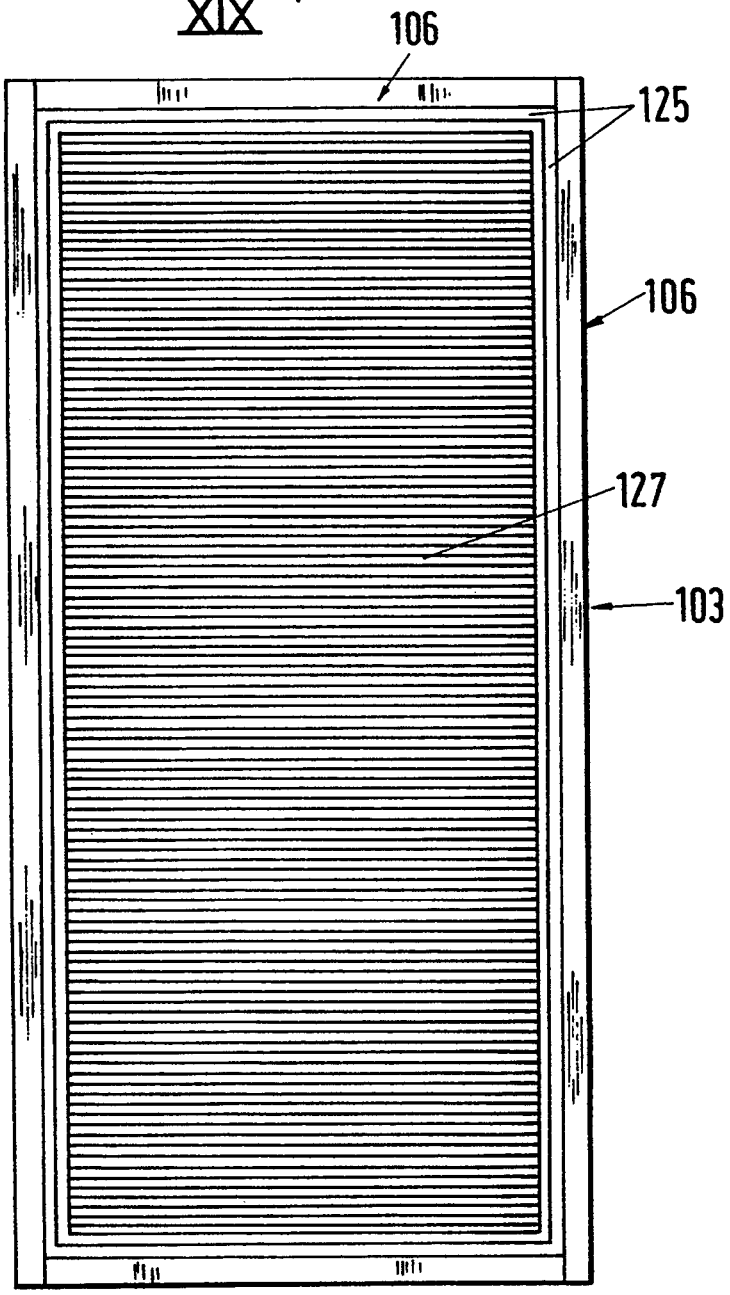
FIG. 21 is an end view in direction of arrow XXI in FIG. 20.

Approximately in the center of the top plate 116, 116', a fan 130 (FIGS. 16, 19, 20) is fastened. For its fastening two parallel transverse stays 131 and 132 are preferably provided at the narrow sides of the housing 105 (FIG. 16). They are spaced at a distance from one another that corresponds to the width of the fan 130 between the two longitudinal sides of the housing. The ends of the transverse stays 131, 132 are connected to the edges of the top plates 116, 116'; preferably, they are welded thereto (FIG. 16). The fan 130 is recessed within the top plate 116, 116' such that its upper side is flush with the free ends 118, 118' of the L-shaped projections 119, 119' of the top plates 116, 116'. With the transverse stays 131, 132, which are preferably of a V-shaped cross-section, the filter-fan unit 103, 103' is sufficiently stiffened.

The transverse stays 131, 132 may also be omitted. The fan 130 in this case is directly connected to the top plate 116, 116'. The fan 130 then has a holder plate 133 with which it rests on the outer edges of the top plate 116, 116'.

Since the walls 106, 106' of the housing 105 are of a simple embodiment and connected with simple connecting elements such as screws, rails, straps etc. to one another, the housing 105 is constructively simple and stable and can be manufactured in an inexpensive manner.

Figure 23:
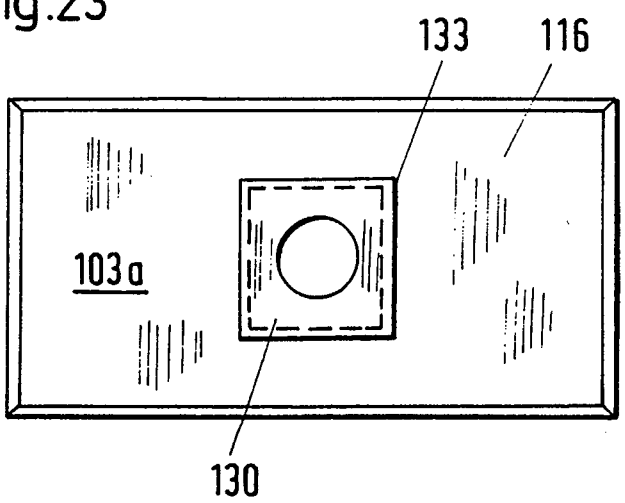
FIG. 23 is a filter-fan unit according to FIG. 22 in a plan view.
Figure 17:
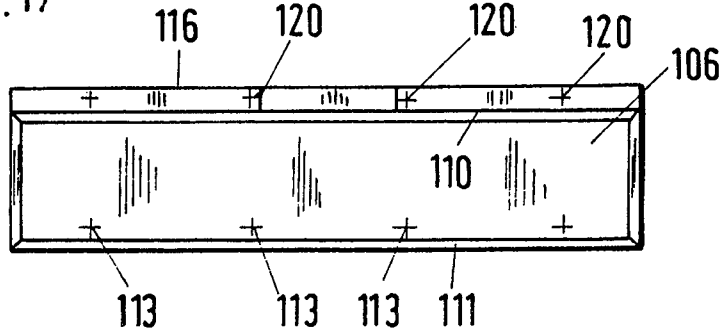
FIG. 17 is an end view in direction of arrow XVII in FIG. 16.
Figure 22:
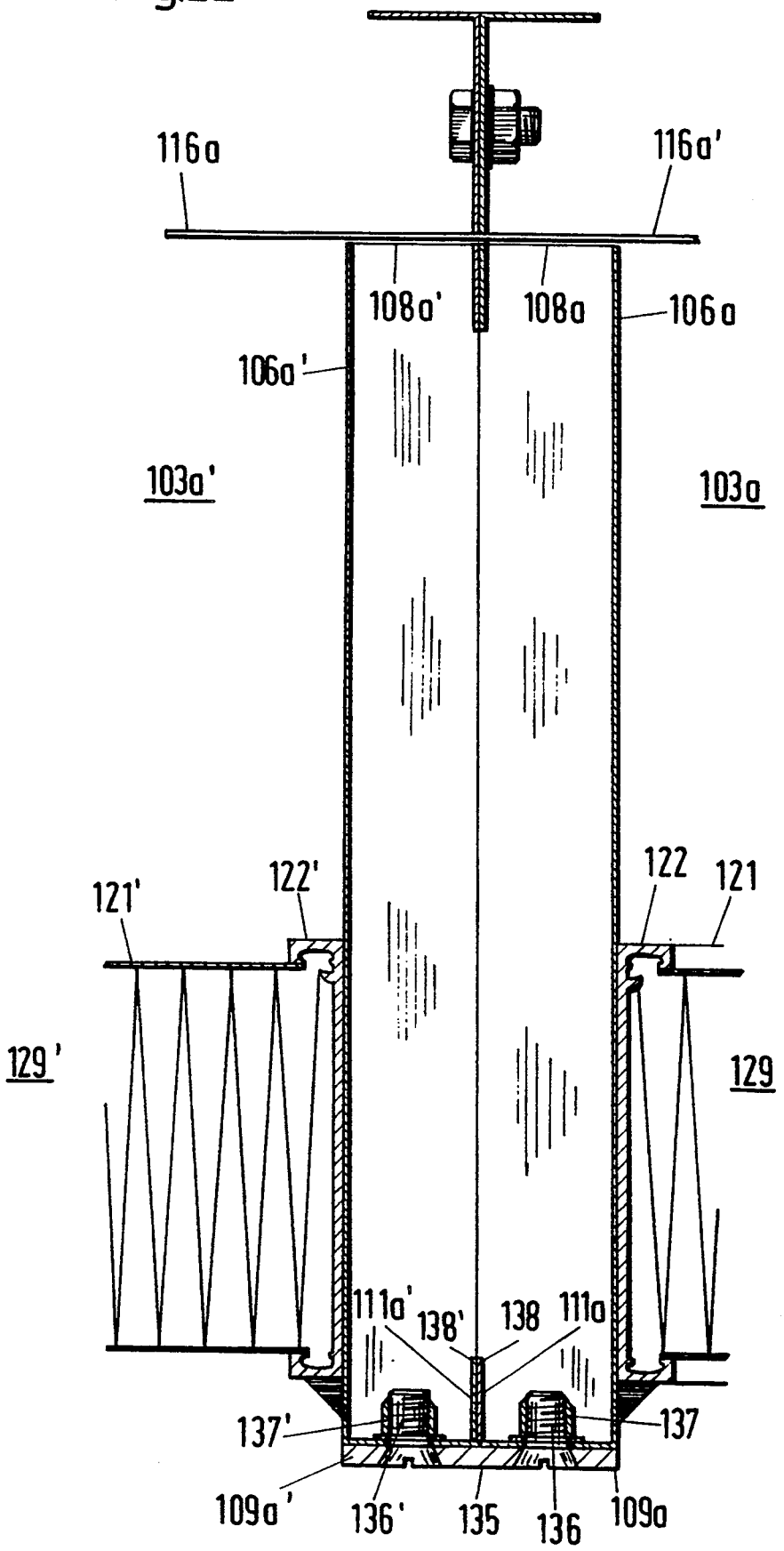
FIG. 22 is a further embodiment of a filter-fan unit of the inventive cleaning device in a representation corresponding to FIG. 15.

The embodiment according to FIGS. 22 and 23 differs from the aforedescribed embodiments substantially only in that the abutting housing walls **106*a*, 106*a'* of the filter-fan unit 103*a*, 103*a'* are connected to one another with a connecting member 135, for example, a T-piece, a cross-member, or a strap which are connected to the lower legs 109*a*, 109*a'* of the walls. The threaded bolt is no longer required in this embodiment. The connecting member 135 is connected with screws 136, 136' to the underside of the legs 109*a*, 109*a'* which for this purpose are provided with threaded sleeves 137, 137'** welded to the inner sides, i.e., they are therefore connected to the inner sides in a form-fitting manner.

The filters 129, 129' with their frames 122, 122' extend to approximately the level of the free ends 138, 138' of the legs **111*a*, 111*a'*. They are thus positioned at a lower level than the filter of the embodiment according to FIGS. 15–21**.

Instead of the L-shaped projections of the top plates **116*a*, 116*a'* for connecting neighboring top plates it is also possible to use a connecting member 135 which is connected in the same manner to the upper legs 108*a*, 108*a'* of the housing walls 106, 106*a'* as the connecting elements at the lower legs 109*a*, 109*a'*. As mentioned before, in this embodiment the fan 130 is connected with its holding plate 133 at the top plates 116*a*, 116*a'***.

Figure 24:
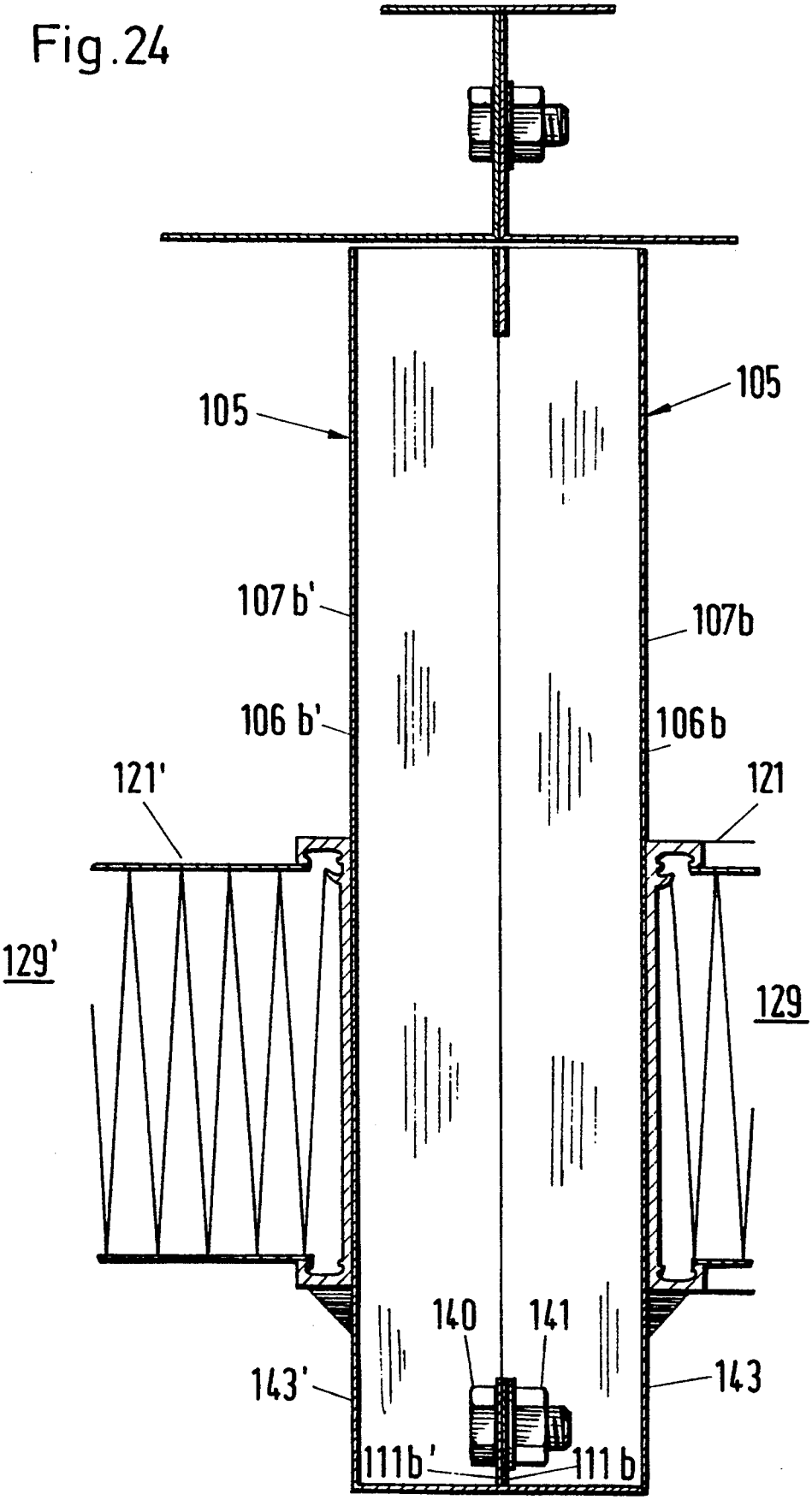
FIG. 24 is a further embodiment of a filter-fan unit of the inventive cleaning device in a representation corresponding to FIGS. 15 and 22.

The embodiment according to FIG. 24 differs from the embodiment according to FIGS. 15–21 substantially only in that for connecting the neighboring housing walls **106*b*, 106*b'* at their lower areas no threaded bolts, but screws 140 are used. They are inserted into openings of the abutting legs 111***b*, 111*b*′ of the walls 106*b*, 106*b*′. For mounting the screws 140 with nuts 141, mounting openings 143, 143′ are provided at the inner sides 107*b*, 107*b*′ which are sealed in the outward direction by stoppers not represented in the drawings. In this embodiment the filters 129, 129′ are positioned lower than in the embodiment according to FIGS. 15 to 21, but above the legs 111*b*, 111*b*′ and the mounting opening 143, 143′.

In the embodiments according to FIGS. 22 to 24 the filters can also be simply and quickly removed from the housing 105 and exchanged.

In the embodiments according to FIGS. 15 to 24 the filter-fan units are advantageously sealed relative to one another. The housing walls 105 are formed by simple profiled parts which are provided with angled portions at their upper and lower edges. At the lower edges of the housing walls 106, 106′, 106*a*, 106*a*′, 106*b*, 106*b*′, the delimiting wall portions can be easily fastened. They are advantageously screwed into the lower edges of the housing walls preferably made of metal.

The connecting members 135 provide a high stiffness and load capacity to the construction units made of the filter-fan units. When the connecting members 135 are embodied as strips, two adjacent filter-fan units can be easily connected to one another with their corresponding edges. For a T-shaped embodiment of the connecting members 135 the lateral edges of neighboring filter-fan units are attached to one another. Cross-shaped connecting members 135 are used to connect the junctions of four abutting filter-fan units to form a construction unit.

The filters according to FIGS. 15 to 24 can be removed from the housing when it needs to be replaced. It is also possible to insert conventional commercially available filters into the housing. Since the housing of the filter-fan unit in itself does not serve to support the filter elements of the filter, but the frame, it can be manufactured in a simple manner so as to provide a stable housing at low cost. When exchanging the filters, the housing of the filter-fan unit must not be exchanged so that a simple and especially inexpensive replacement of the filters is ensured.

The embodiment according to FIGS. 25 to 28 is advantageously to be used in pharmacological and food preparation facilities. The filter-fan unit 201 comprises a rectangular housing 202 having outer walls 203 to 206 which are essentially planar. Accordingly, they are easy to clean. With respect to their use in pharmacological and food preparation facilities this is especially advantageous in view of the hygiene requirements.

The housing 202 is closed in the upward direction by a prefilter 207. Below the prefilter 207 the fan 208 is provided which, in the embodiment shown in the drawings, is centrally located with respect to the prefilter 207.

Figure 26:
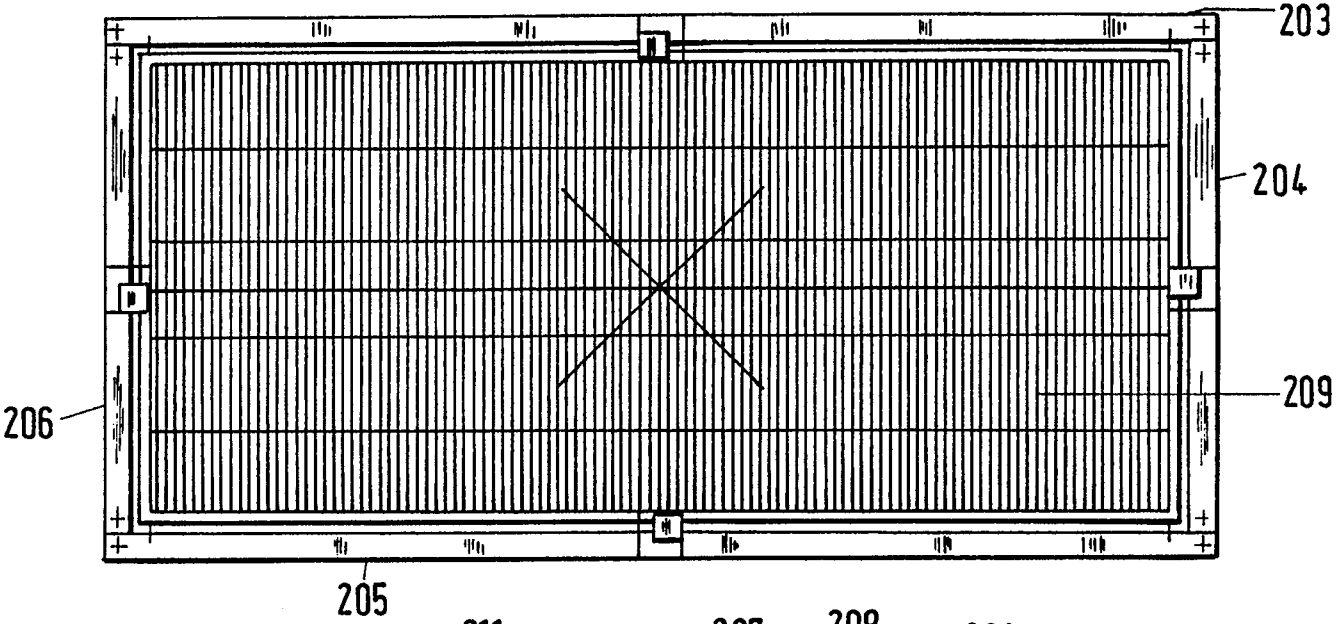
FIG. 26 is a view along the line XXVI—XXVI in FIG. 25.
Figure 28:
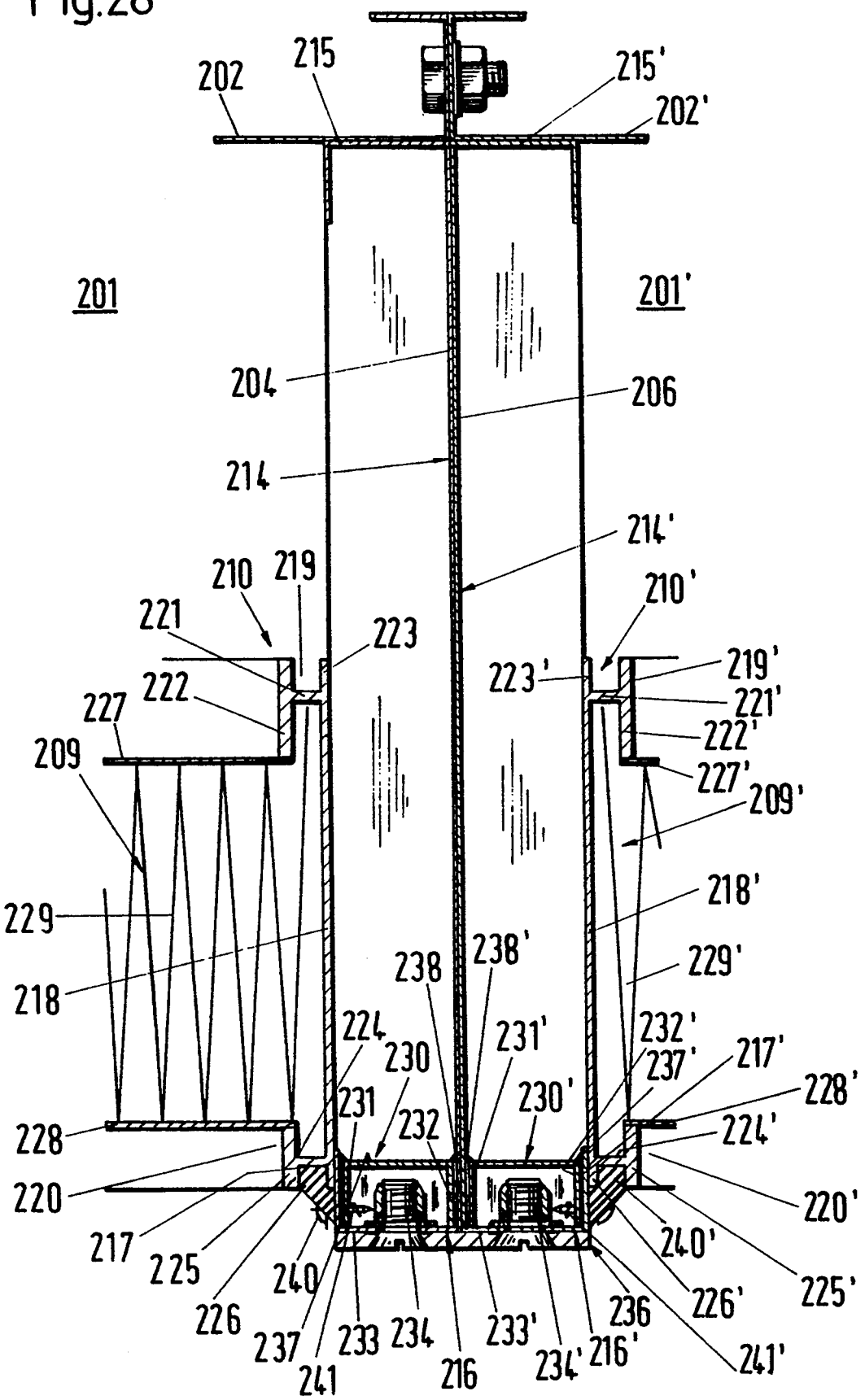
FIG. 28 is an enlarged representation partially in section of two filter-fan units connected to one another according to FIG. 25.

At a distance below the fan 208 the filter element 209 is provided which is supported at a frame 210 (FIG. 28). As shown in FIG. 26, the housing 202 is closed in the downward direction by the filter element 209.

Figure 25:
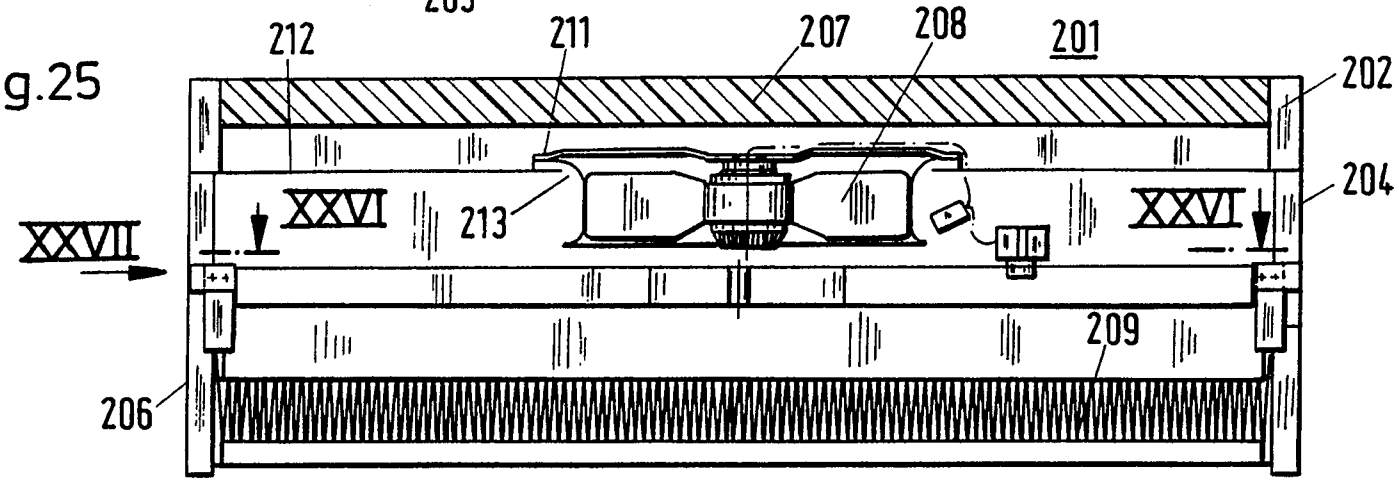
FIG. 25 is a further embodiment of a filter-fan unit of the inventive cleaning device.
Figure 27:
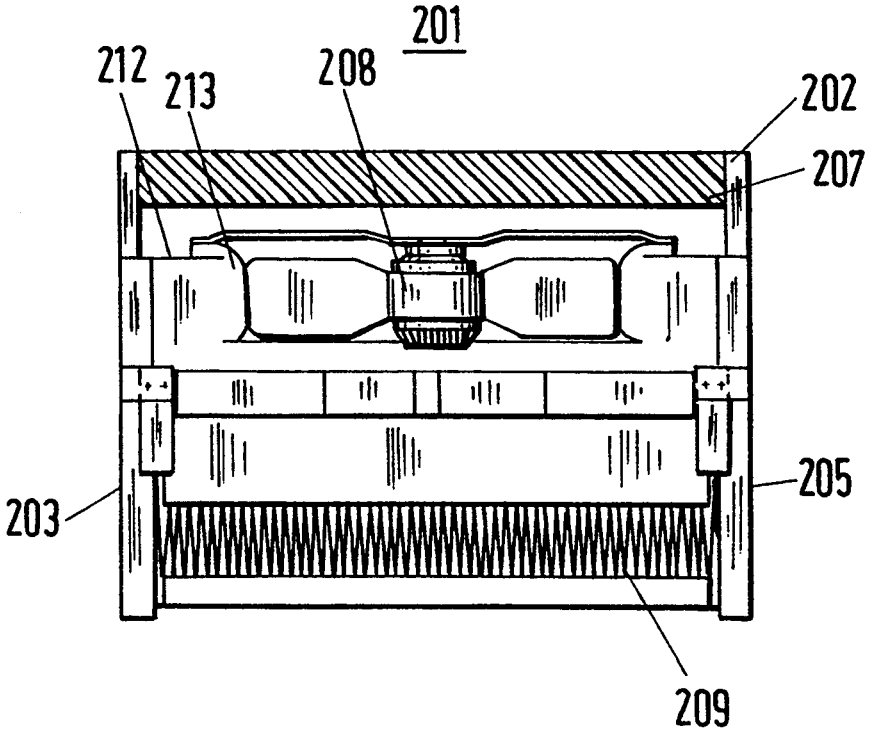
FIG. 27 is an end view in direction of arrow XXVII in FIG. 25.

The fan 208 is advantageously suspended within the housing 202. The fan 208 has a projecting edge 211 extending at least partially about its circumference (FIG. 25) which serves to connect the fan to the carrier 212, preferably a support plate that is connected to the housing sidewalls. The fan 208 extends past an opening 213 within the support 212 (FIGS. 25 and 27).

The filter-fan units are connected to self-supporting construction units as described above. In FIG. 28 two filter-fan units 201, 201′ are connected to one another. They are abutting one another with their planar, closed outer sides 204, 206 provided at profiled walls 214, 214′ which at their upper and lower edges have L-shaped projections 215, 216, 215′, 216′. The frame 210, 210′ is connected to the outer sides of the free ends 217, 217′ of the lower L-shaped projections 216, 216′. The frame has a plate-shaped base body 218, 218′ which is substantially thicker than the profiled walls 214, 214′ which are preferably made of profiled sheet metal. The frame 210, 210′ extending over the periphery of the housing 202, 202′ is provided at its upper and lower edges with holders 219, 220, 219′, 220′ having an H-shaped cross-section. These holders are a unitary part of the frame and serve for fastening thereto the filter elements 209, 209′.

The upper holder 219, 219′ has a crossbar 221, 221′ which connects two legs 222, 223, 222′, 223′ to one another. One leg 223, 223′ is formed by the upper end section of the base body 218, 218′.

The lower holder 220, 220′ also has a crossbar 224, 224′ which connects two legs 225, 226, 225′, 226′. One leg 226, 226′ is formed by the lower end section of the base body 218, 218′. The legs 222, 222′, 225, 225′ are positioned at the same height of the side of the base body 218, 218′ facing away from the profiled walls 214, 214′. On the end faces of the legs 222, 222′, 225, 225′ the edges of the plate-shaped covers 227, 228, 227′, 228′ are resting between which the filters 229, 229′ of the filter elements 209, 209′ are lying and which serve as a grip protection for the filter 229, 229′. Preferably, the covers 227, 228, 227′, 228′ are formed by mesh metal or expanded metal.

The lower profiled sections 216, 216′ of the profiled walls 214, 214′ form grooves into which a U-shaped profiled member 230, 230′ can be inserted. In the shown embodiment the housing 202, 202′ has a rectangular contour. The profile section 215, 216, 215′, 216′ extend over each housing side. Correspondingly, the profiled members 230, 230′ are provided over the entire housing circumference. The profiled members 230, 230′ with the free ends of their legs 231, 232, 231′, 232′ rest on the bottom 233, 233′ of the profiled sections 216, 216′.

The profiled members 230, 230′ cover screws 234, 234′ and threaded sleeves 235, 235′ which are formed corresponding to the embodiment of FIG. 22. The profiled end sections 216, 216′ may be filled with a permanent-elastic material instead of the profiled members 230, 230′. With the screws 234, 234′ which are threaded into the threaded sleeves 235, 235′ connected to the bottom 233, 233′ of the profiled end sections 216, 216′, the connecting member 236 is fastened which is embodied identical to the embodiment of FIG. 22. With the connecting member 236 neighboring filter-fan units 201, 201′ are connected to self-supporting construction units.

The gaps between the legs 231, 232, 231′, 232′ of the profiled members 230, 230′ and the legs 217, 217′ of the profiled end sections 216, 216′ as well as of the profiled wall 214, 214′are sealed with sealings 237, 238, 237′, 238′ which are preferably made of permanent-elastic material. This prevents reliably a penetration of dirt particles from the housing 202, 202′ into the clean air zone.

Furthermore, the circumferentially extending gap between the legs 226 and 218 is also sealed by a permanent-elastic material 240, 240′. The filter element is secured by screws 241, 241′ which are distributed over the length of the housing which penetrate the legs 226, 226', 231, 231' of the profiled end sections 216, 216' and the profiled member 230, 230'. The filter element, as shown in FIG. 28, is areally supported at the outer side of the legs 226, 226' of the profiled end sections 216, 216'. Thus, the housing 202, 202' is reliably sealed in the outward direction.

In this embodiment the profiled walls 214, 214' with their open side face inwardly to the pressure chamber of the fan 208 so that the planar sides of the profiled walls in the aforedescribed manner face outwardly. The filter-fan units 201, 201' are therefore easy to clean.

At the upper end the filter-fan units 201, 201' are connected in the same manner as shown in the embodiment according to FIG. 15.

The present invention is, of course, in no way restricted to the specific disclosure of the specification and drawings, but also encompasses any modifications within the scope of the appended claims.

What we claim is:

1. A cleaning device for a clean room; said cleaning device comprising:

at least two filter-fan units each comprising at least one filter and at least one fan; and connecting elements for connecting said filter-fan units to one another to form a self-supporting construction unit.

2. A cleaning device according to claim 1, wherein each said filter-fan unit comprises a housing having profiled elements, and wherein said connecting elements are selected from the group consisting of bars and angle pieces.

3. A cleaning device according to claim 2, wherein said connecting elements are T-shaped.

4. A cleaning device according to claim 2, wherein said connecting elements are cross-shaped.

5. A cleaning device according to claim 2, further comprising clamping pieces selected from the group consisting of keys and hammer bolts, said clamping pieces connected to said profiled elements and interposed between said connecting elements and said profiled elements.

6. A cleaning device according to claim 5, wherein said profiled elements have substantially C-shaped receiving means for receiving therein said clamping pieces.

7. A cleaning device according to claim 2, wherein each said housing comprises a wall with an upper and a lower longitudinal edge and wherein said profiled elements are provided at said wall.

8. A cleaning device according to claim 7, wherein said wall is a sidewall of said housing, said sidewall being a hollow profiled member.

9. A cleaning device according to claim 7, wherein said profiled elements are located at said upper longitudinal edge of said wall.

10. A cleaning device according to claim 7, wherein said profiled elements are located at said lower longitudinal edge of said wall.

11. A cleaning device according to claim 7, wherein said profiled elements are located at an outwardly facing side of said wall.

12. A cleaning device according to claim 7, wherein said profiled elements extend substantially over an entire longitudinal length of said wall.

13. A cleaning device according to claim 7, wherein at least one of said upper and said lower longitudinal edges of said wall has at least two of said profiled elements located directly adjacent to one another.

14. A cleaning device according to claim 13, wherein said at least two of said profiled elements are oriented perpendicularly to one another.

15. A cleaning device according to claim 2, further comprising at least one sealing element located between two neighboring ones of said filter-fan units.

16. A cleaning device according to claim 15, wherein said sealing element is located within one said profiled elements.

17. A cleaning device according to claim 10, wherein said housing further comprises a bottom wall in the form of a grate.

18. A cleaning device according to claim 17, wherein said housing further comprises a longitudinal channel located above a lowermost one of said profiled elements forming said lower longitudinal edge of said wall, said bottom wall extending into said longitudinal channel.

19. A cleaning device according to claim 17, wherein said bottom wall is made of metal mesh.

20. A cleaning device according to claim 2, further comprising supports for supporting said construction unit, said supports connected with connectors to said profiled elements.

21. A cleaning device according to claim 20, wherein said connectors are screws.

22. A cleaning device according to claim 20, further comprising clamping pieces connected to said profiled elements and interposed between said supports and said profiled elements for detachably connecting said supports to said profiled elements, said connectors extending through said supports and engaging said clamping pieces.

23. A cleaning device according to claim 20, further comprising supporting members selected from the group consisting of longitudinal supporting members and transverse supporting members, with at least said longitudinal supporting members connecting said supports to one another.

24. A cleaning device according to claim 23, wherein said transverse supporting members are connected on top of said longitudinal supporting members.

25. A cleaning device according to claim 24, wherein said transverse supporting members are screwed to said longitudinal supporting members.

26. A cleaning device according to claim 23, wherein said supports and said longitudinal supporting members are detachably connected.

27. A cleaning device according to claim 7, further comprising suspending members for suspending said construction unit, said suspending members comprising couplings for connecting said suspending members to said wall.

28. A cleaning device according to claim 27, wherein said couplings are connected to said profiled elements of said wall.

29. A cleaning device according to claim 27, wherein said suspending members are cables.

30. A cleaning device according to claim 1, further comprising electrical connecting elements for electrically connecting at least some of said filter-fan units of said construction unit with one another.

31. A cleaning device according to claim 30, wherein said filter-fan unit has an electric plug for receiving one of said electrical connecting elements.

32. A cleaning device according to claim 30, wherein said electrical connecting elements are electrical cables.

33. A cleaning device according to claim 2, wherein said filter-fan unit further comprises a frame for connecting said filter to said housing.

34. A cleaning device according to claim 33, wherein said frame extends over the entire height of said filter and is supported at said housing.

35. A cleaning device according to claim 2, wherein each said housing has sidewalls and wherein abutting ones of said sidewalls of neighboring said filter-fan units are detachably connected to one another.

36. A cleaning device according to claim 35, wherein said abutting sidewalls are screwed together.

37. A cleaning device according to claim 35, further comprising bolts for detachably connecting said abutting sidewalls, said bolts penetrating said abutting sidewalls below said filters.

38. A cleaning device according to claim 35, wherein each said abutting sidewall has an upper and a lower edge with an L-shaped outwardly extending projection, said L-shaped projections having a free leg extending parallel to said abutting sidewall toward one another, with said free legs of said abutting sidewalls abutting one another.

39. A cleaning device according to claim 38, wherein said free legs of said projections at said lower edges are screwed together.

40. A cleaning device according to claim 35, wherein each said housing has a top plate with a substantially L-shaped projection, extending upwardly from said housing, said L-shaped projection having a free leg extending parallel to said top plate toward a center of said housing, wherein said neighboring filter-fan units are connected to one another with said L-shaped projections.

41. A cleaning device according to claim 40, wherein said L-shaped projections are screwed together.

42. A cleaning device according to claim 2, wherein each said housing has planar sidewalls, wherein neighboring ones of said filter-fan units abut one another with said planar sidewalls.

43. A cleaning device according to claim 42, wherein each said planar sidewall has a lower edge with a profiled end section and a profiled member inserted into said profiled end section.

44. A cleaning device according to claim 42, wherein each said planar sidewall has a lower edge with a profiled end section filled with a permanent-elastic sealing material.

45. A cleaning device according to claim 1, further comprising holders for supporting said construction units.

46. A cleaning device according to claim 45, wherein said holders are angle supports.

47. A cleaning device according to claim 1, further comprising a separating device connected to a periphery of said construction unit for separating said construction unit from the surroundings.

* * * * *